US007714814B2

(12) United States Patent
Bae et al.

(10) Patent No.: US 7,714,814 B2
(45) Date of Patent: May 11, 2010

(54) METHOD AND APPARATUS FOR DRIVING ELECTRO-LUMINESCENCE DISPLAY PANEL WITH AN AGING PULSE

(75) Inventors: Hyo Dae Bae, Daegu (KR); Hak Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1302 days.

(21) Appl. No.: 11/205,164

(22) Filed: Aug. 17, 2005

(65) Prior Publication Data

US 2006/0038756 A1 Feb. 23, 2006

(30) Foreign Application Priority Data

| | | |
|---|---|---|
| Aug. 18, 2004 | (KR) | 10-2004-0065087 |
| Sep. 4, 2004 | (KR) | 10-2004-0070600 |
| Sep. 4, 2004 | (KR) | 10-2004-0070601 |
| Dec. 31, 2004 | (KR) | 10-2004-0118586 |

(51) Int. Cl.
*G09G 3/30* (2006.01)

(52) U.S. Cl. ..... 345/78

(58) Field of Classification Search ..... 345/76–83; 315/169.1–169.3

See application file for complete search history.

(56) References Cited

U.S. PATENT DOCUMENTS

| | | | | |
|---|---|---|---|---|
| 4,338,598 | A | 7/1982 | Ohba et al. | |
| 4,636,789 | A | 1/1987 | Yamaguchi et al. | |
| 5,923,308 | A | 7/1999 | Wei et al. | |
| 6,130,654 | A * | 10/2000 | Hayashi et al. | 345/63 |
| 6,222,323 | B1 | 4/2001 | Yamashita et al. | |
| 6,337,542 | B1 | 1/2002 | Hanaki et al. | |
| 6,369,515 | B1 | 4/2002 | Okuda | |
| 6,611,107 | B2 * | 8/2003 | Mikami et al. | 315/169.1 |
| 6,873,309 | B2 * | 3/2005 | Suzuki et al. | 345/76 |
| 7,205,965 | B2 * | 4/2007 | Mikami et al. | 345/76 |
| 2002/0101179 | A1 | 8/2002 | Kawashima | |
| 2003/0034939 | A1 | 2/2003 | Moon | |
| 2003/0038760 | A1 * | 2/2003 | Kim et al. | 345/76 |
| 2003/0160745 | A1 * | 8/2003 | Osame et al. | 345/82 |
| 2004/0104686 | A1 | 6/2004 | Shin et al. | |
| 2004/0150594 | A1 | 8/2004 | Koyama et al. | |
| 2004/0239257 | A1 | 12/2004 | Yang | |
| 2008/0272989 | A1 * | 11/2008 | Takahashi et al. | 345/76 |

FOREIGN PATENT DOCUMENTS

| | | | |
|---|---|---|---|
| EP | 0 784 305 | A1 | 7/1997 |
| EP | 1 414 007 | A2 | 4/2004 |
| EP | 1 465 145 | A2 | 10/2004 |
| KR | 1999-0030880 | | 7/1999 |
| KR | 2003-0015782 | A | 2/2003 |

* cited by examiner

*Primary Examiner*—Sumati Lefkowitz
*Assistant Examiner*—Rodney Amadiz
(74) *Attorney, Agent, or Firm*—Birch, Stewart, Kolasch & Birch, LLP

(57) ABSTRACT

The present invention relates to a method and apparatus for driving an electro-luminescence display panel capable of doing an aging operation upon driving.

A method of driving an electro-luminescence display panel according to the present invention includes: a scan period when electro-luminescence cells formed at a cross of both a plurality of scan lines and a plurality of data lines are line-sequentially emitted; and an aging period when an aging is performed in the electro-luminescence cells at the same time by applying a reverse bias, wherein the scan period and the aging period are repeated for each frame.

18 Claims, 27 Drawing Sheets

FIG.24

| | 1ST STATE | 2ND STATE | 3RD STATE | 4TH STATE | 5TH STATE | 7TH STATE | 8TH STATE | 9TH STATE | 10TH STATE | 11TH STATE | 12TH STATE | 13TH STATE |
|---|---|---|---|---|---|---|---|---|---|---|---|---|
| R SUB-PIXEL | High | Low | Low | High | High | Low | Floating | Floating | High | Low | High | Low |
| G SUB-PIXEL | Low | High | Low | High | Low | High | High | Low | Floating | Floating | Low | High |
| B SUB-PIXEL | Low | Low | High | Low | High | High | Low | High | Low | High | Floating | Floating |

METHOD AND APPARATUS FOR DRIVING ELECTRO-LUMINESCENCE DISPLAY PANEL WITH AN AGING PULSE

This application claims the benefit of Korean Patent Application No. P2004-65087 filed in Korea on Aug. 18, 2004, No. P2004-70600 and No. P2004-70601, filed in Korea on Sep. 4, 2004, and No. P2004-118586 filed in Korea on Dec. 31, 2004, which are hereby incorporated by reference.

BACKGROUND OF THE INVENTION

1. Field of the Invention

The present invention relates to an electro-luminescence display device, and more particularly, to a method and apparatus for driving an electro-luminescence display panel capable of doing an aging operation upon driving.

2. Description of the Related Art

In recently, there has been developed various flat panel displays with a reduced weight and bulk that are free from the disadvantage of a cathode ray tube CRT. Such flat panel displays include a liquid crystal display LCD, a field emission display FED, a plasma display panel PDP, and an electro-luminescence (hereinafter, referred to as an EL) display devices.

Among these, the EL display panel is a self-luminous device capable of light-emitting a phosphorous material by a re-combination of electrons with holes. The EL display panel is generally classified into an inorganic EL panel using the phosphorous material as an inorganic compound and an organic EL panel using it as an organic compound. Such an EL display panel has many advantages of a low voltage driving, a self-luminescence, a thin-thickness, a wide viewing angle, a fast response speed and a high contrast, etc, such that it can be highlighted into a post-generation display device.

The EL display device includes: an anode formed of a transparent conductive material on a substrate; and a hole injection layer, a hole carrier layer, a light-emitting layer, an electron carrier layer, and an electron injection layer made of an organic material, and a cathode made of a metal having a low work function, which are disposed thereon. If a forward voltage is applied between the anode and the cathode, then electrons generated from the cathode move via the electron injection layer and the electron carrier layer to the light-emitting layer and holes generated from the anode moves via the hole injection layer and the hole carrier layer to the light-emitting layer. Accordingly, the electrons and the holes fed from the electron carrier and the hole carrier layer are recombined each other in the light-emitting layer, to thereby emit light. In this case, the brightness of the organic EL device is in portion to a current between the anode and the cathode.

FIG. 1 is a circuit diagram showing equivalently a passive matrix type organic EL display device in which an organic EL element is arranged in a matrix type, and FIG. 2 is a driving waveform diagram of an EL panel 20 shown in FIG. 1.

The EL display device shown in FIG. 1 includes: an EL panel 20 having an EL cell 26 formed at a cross of both scan lines SL1 to SLn and data lines DL1 to DLm; a scan driver 22 for driving the scan lines SL1 to SLn; and a data driver 24 for driving the data lines DL1 to DLm.

Each of the EL cells 26 formed in the EL panel 20 is represented as a diode, which is connected in a forward direction between the data line DL and the scan line SL. Herein, the data line DL is equivalently an anode and the scan line SL is equivalently a cathode. If a negative scan pulse, that is, a low scan voltage Vlow, is supplied to the scan line SL and a positive data signal(current) is supplied to the data line DL to as shown in FIG. 2 apply a forward voltage to each EL cell 26, then each EL cell 26 emits light to generate light corresponding to the data signal. On the other hand, if a high scan voltage Vhigh is supplied to the scan line SL to thereby apply a reverse voltage to each EL cell 26, then each EL cell 26 does not emit light.

The scan driver 22, as shown in FIG. 2, sequentially supplies a scan pulse to a n number of scan lines SL1 to SLn. In other words, the scan driver 22 sequentially supplies the low scan voltage Vlow to the scan lines SL1 to SLn during a scan period to thereby sequentially make the scan lines SL1 to SLn to be enable, and supplies the high scan voltage Vhigh during the rest period to make the scan lines SL1 to SLn to be disable. Further, the scan driver 22 repeats the sequential driving of the scan lines SL1 to SLn for each frame F.

The data driver 24 supplies the data signal to the m number of data lines DL1 to DLm for each period when the scan lines SL1 to SLn are enabled.

In order for a stable driving in the related art organic EL display device, an aging process to make the EL cells 26 to be a reverse bias state is performed in manufacturing process. However, even the aging process is performed in the organic EL display device during the manufacturing process, the organic EL display device has a problem that its life-span becomes shorten because the EL cells 26 becomes deteriorated with the passage of driving time or a line defect such as short defect becomes generated due to a stress. In order to solve this problem, an aging operation is needed in the driving of the organic EL display device.

SUMMARY OF THE INVENTION

Accordingly, it is an object of the present invention to provide a method and apparatus for driving an electro-luminescence display panel capable of doing an aging operation upon driving.

In order to achieve these and other objects of the invention, a method of driving an electro-luminescence display panel according to the present invention includes: a scan period when electro-luminescence cells formed at a cross of both a plurality of scan lines and a plurality of data lines are line-sequentially emitted; and an aging period when an aging is performed in the electro-luminescence cells at the same time by applying a reverse bias, wherein the scan period and the aging period are repeated for each frame.

A high scan voltage is supplied the plurality of scan lines, and a low voltage is supplied to the plurality of data lines, in the aging period.

A low scan voltage is supplied to a scan line for an enable, and a first high scan voltage is supplied to a scan line for a disable, in the scan period, and wherein a second high scan voltage larger than the first high scan voltage is supplied to the plurality of scan lines in the aging period.

A method of driving an electro-luminescence display panel according to the present invention includes: a scan period when electro-luminescence cells formed at a cross of both a plurality of scan lines and a plurality of data lines are emitted; and an aging period when a voltage difference is generated between adjacent scan lines as floating the plurality of data lines to make a self-aging is performed in the electro-luminescence cells.

Aging voltages opposite to each other are applied to the adjacent scan lines in the aging period.

Any one aging voltage of high and low aging voltages is applied to an odd-numbered scan line, and an aging voltage opposite to that of the odd-numbered scan line is applied to an even-numbered scan line, in the aging period.

The aging voltage applied to the plurality of scan lines is reversed at least one time in the aging period.

The aging period is divided into a plurality of periods, and the aging voltage applied to each of the scan lines is reversed for each boundary spot of the divided periods.

The aging voltage applied to each of the scan lines is reversed at least one more time in the divided periods.

A low scan voltage is supplied to a scan line for an enable and a first high scan voltage is supplied to a scan line for a disable, in the scan period, and wherein a second high scan voltage larger than the first high scan voltage or equal to the first high scan voltage is supplied as the high aging voltage, and the low scan voltage is supplied as the low aging voltage, in the aging period.

The scan period and the aging period are repeated for each frame.

A method of driving an electro-luminescence display panel according to the present invention includes: a scan period when electro-luminescence cells formed at a cross of both a plurality of scan lines and a plurality of data lines are emitted; and an aging period when a voltage difference of a multilevel is generated between adjacent scan lines as floating the plurality of data lines to make a self-aging is performed in the electro-luminescence cells.

Aging voltages, which are changed in an opposite sequence to each other, are applied to the adjacent scan lines in the aging period.

The aging period further includes a neutralization step when the same aging voltage is applied to the adjacent scan lines.

A multilevel aging voltage, in which a voltage difference between an odd-numbered scan line and an even-numbered scan line is sequentially increased or decreased, is applied to the scan line in the aging period.

A multilevel aging voltage, in which a voltage difference between an odd-numbered scan line and an even-numbered scan line is sequentially increased and then decreased or is sequentially decreased and then increased, is applied to the scan line in the aging period.

An aging voltage, which is changed to a multilevel, is applied to an odd-numbered scan line, and an aging voltage, which is changed in a sequence opposite to that of the odd-numbered scan line, is applied to an even-numbered scan line, in the aging period.

A multilevel aging voltage, which is sequentially increased, is applied to any one of an odd-numbered scan line and an even-numbered scan line, and a multilevel aging voltage, which is sequentially decreased, is applied to the rest scan line, in the aging period.

A multilevel aging voltage, which is sequentially increased and then decreased, is applied to any one of an odd-numbered scan line and an even-numbered scan line, and a multilevel aging voltage, which is sequentially decreased and then increased, is applied to the rest scan line, in the aging period.

A multilevel aging voltage, which is sequentially increased or decreased, is applied to any one of an odd-numbered scan line and an even-numbered scan line, and a definite voltage is applied to the rest scan line, in the aging period.

A multilevel aging voltage, which is sequentially increased and then decreased or sequentially decreased and then increased, is applied to any one of an odd-numbered scan line and an even-numbered scan line, and a definite voltage is applied to the rest scan line, in the aging period.

The definite voltage applied in the aging period is a voltage identical to a lowest aging voltage of the multilevel aging voltage.

The definite voltage applied in the aging period is identical to a low scan voltage supplied as an enable voltage to the scan line in the scan period.

The aging period further includes a neutralization step, in which the same aging voltage is applied to the odd-numbered and the even-numbered scan lines.

The odd-numbered and the even-numbered scan lines are the same as a middle voltage of the multilevel aging voltage in the neutralization step.

The multilevel aging voltage is a voltage in which a voltage between a highest aging voltage, larger than a high scan voltage supplied as a disable voltage to the scan line or equal to the high scan voltage, and a lowest aging voltage, equal to a low scan voltage supplied as an enable voltage, is divided into a multilevel.

The multilevel aging voltage is repeated in the aging period.

The scan period and the aging period are repeated for each frame.

A method of driving an electro-luminescence display panel, according to the present invention includes: emitting electro-luminescence cells formed at a cross of both a plurality of scan lines and a plurality of data lines in a scan period; and making a self-aging of the organic electro-luminescence cells as floating the plurality of scan lines to have a voltage difference between adjacent data lines, in an aging period directly after the scan period.

Any one of first to third voltages is supplied to a ith sub-pixel connected to the data line, and a voltage different from the voltage supplied to the ith sub-pixel is supplied to sub-pixels adjacent to the ith sub-pixel, in the aging period.

The voltage supplied to each of the sub-pixels is repeatedly applied for each pixel including each of the sub-pixels.

The first to the third voltages, which are different from each other, are applied to each of the sub-pixels connected to the data line in the aging period.

The first to the third voltages are repeatedly applied for each pixel including each of the sub-pixels.

The second voltage has a voltage level different from that of the first voltage, and is formed by floating the third voltage.

An apparatus of driving an electro-luminescence display panel according to the present invention includes: an electro-luminescence display panel having an electro-luminescence cell for each cross of both a scan line and a data line; a scan driver to sequentially supply a scan pulse to the scan line in a scan period and to sequentially supply a high aging voltage to the entire scan lines in an aging period, in order to include the scan period and the aging period in each frame; and a data driver to supply a data signal to the data line in the scan period and to supply a low aging voltage to the data line in the aging period to make the entire electro-luminescence cell to be an reverse bias state.

The scan driver supplies a low scan voltage as the scan pulse in the scan period, a first high scan voltage to a disabled scan line in the scan period, and a second high scan voltage larger than the first high scan voltage as the high aging voltage.

The scan driver includes: a shift register having a plurality of stages to shift a start pulse to supply it as each of output signals and a start pulse of next stage, and a plurality of dummy stages to shift an output signal of the last stage in the stages to secure the aging period; and a level shifter part having a plurality of level shifters to level-shift each of the output signals of the shift register to supply it to each of the scan lines.

The scan driver includes: a shift register having a plurality of stages to shift a start pulse to supply it as each of output signals and a start pulse of next stage; and a level shifter part having a plurality of level shifters to level-shift each of the output signals of the shift register to supply it to each of the scan lines.

The start pulse of the next stage is delayed to be supplied to include the aging period next the scan period.

Each of the stages supplies an output signal of a first voltage corresponding to the shifted start pulse, and further supplies an output signal of a second voltage.

When each of the level shifters is supplied with the output signal of the first voltage, each of the level shifters selects the low scan voltage, and when each of the level shifters is supplied with the output signal of the second voltage, each of the level shifters selects the first high scan voltage, in the scan period and select the second high scan voltage in the aging period to supply the selected voltage to a corresponding scan line.

Each of the low scan voltage, the first and second high scan voltages is supplied to each of the level shifters.

Each of the low scan voltage and the second high scan voltage is applied to each of the level shifters, and each of the level shifters uses the supplied second high scan voltage in the aging period and voltage-drops the second high scan voltage to the first high scan voltage in the scan period to use it.

An apparatus of driving an electro-luminescence display panel according to the present invention includes: a data driver to apply a data signal to a data line in a scan period and to float the data line in an aging period; a scan driver to apply a scan pulse to a scan line in the scan period and to make adjacent scan lines have a voltage difference in the aging period; and an electro-luminescence display panel having an electro-luminescence cell formed for each a cross of both the scan line and the data line, wherein the electro-luminescence cell is emitted in accordance with the data signal in the scan period and a self-aging is performed in the electro-luminescence cell in the aging period.

The scan driver applies an aging voltage opposite to that of the adjacent scan line in the aging period.

The scan driver applies any one aging voltage of high and low aging voltages to an odd-numbered scan line, and applies an aging voltage opposite to that of the odd-numbered scan line to an even-numbered scan line, in the aging period.

The scan driver reverses at least one time the aging voltage applied to the plurality of scan lines in the aging period.

The scan driver divides the aging period into a plurality of periods, and reverses the aging voltage applied to each of the scan lines for each boundary spot of the divided periods.

The scan driver reverses at least one more time the aging voltage applied to each of the scan lines in the divided periods.

The scan driver supplies a low scan low voltage to a scan line for an enable and supplies a first high scan voltage to a scan line for a disable, in the scan period, and wherein the scan driver supplies a second high scan voltage larger than the first high scan voltage or equal to the first high scan voltage as the high aging voltage, and supplies the low scan voltage as the low aging voltage, in the aging period.

The scan driver repeats the scan period and the aging period for each frame.

The scan driver includes: a shift register having a plurality of stages to shift a start pulse to supply it as each of output signals and a start pulse of next stage, and a plurality of dummy stages to shift an output signal of the last stage in the stages to secure the aging period; and a level shifter part having a plurality of level shifters to level-shift each of the output signals of the shift register to supply the scan pulse to the scan line in the scan period and to supply an aging voltage opposite to that of the adjacent scan lines in the aging period.

The scan driver includes: a shift register having a plurality of stages to shift a start pulse to supply it as each of output signals and a start pulse of next stage; and a level shifter part having a plurality of level shifters to level-shift each of the output signals of the shift register to supply the scan pulse to the scan line in the scan period and to supply an aging voltage opposite to that of the adjacent scan lines in the aging period.

The start pulse of the next stage is delayed to be supplied to include the aging period next the scan period.

Each of the stages supplies an enable signal corresponding to the shifted start pulse, and wherein the level shifter part divides the aging period into a plurality of period when the enable signal is outputted in the each dummy stage, and reverses the aging voltage applied to each of the scan lines for each boundary spot of the divided periods.

The level shifter part reverses at least one more time the aging voltage applied to each of the scan lines in the divided periods.

An apparatus of driving an electro-luminescence display panel according to the present invention includes: a data driver to apply a data signal to a data line in a scan period and to float the data line in an aging period; a scan driver to apply a scan pulse to a scan line in the scan period and to make adjacent scan lines have a multilevel voltage difference in the aging period; and an electro-luminescence display panel having an electro-luminescence cell formed for each a cross of both the scan line and the data line, wherein the electro-luminescence cell is emitted in accordance with the data signal in the scan period and a self-aging is performed in the electro-luminescence cell in the aging period.

The scan driver applies multilevel aging voltages, which are changed in an opposite sequence to each other, are applied to the adjacent scan lines in the aging period.

The scan driver further includes a neutralization step when the same aging voltage is applied to the adjacent scan lines.

The scan driver applies a multilevel aging voltage, in which a voltage difference between an odd-numbered scan line and an even-numbered scan line is sequentially increased or decreased, is applied to the scan line in the aging period.

The scan driver applies a multilevel aging voltage, in which a voltage difference between an odd-numbered scan line and an even-numbered scan line is sequentially increased and then decreased or is sequentially decreased and then increased, is applied to the scan line in the aging period.

The scan driver applies an aging voltage, which is changed to a multilevel, to an odd-numbered scan line, and applies an aging voltage, which is changed in a sequence opposite to that of the odd-numbered scan line, to an even-numbered scan line, in the aging period.

The scan driver applies a multilevel aging voltage, which is sequentially increased, to any one of an odd-numbered scan line and an even-numbered scan line, and applies a multilevel aging voltage, which is sequentially decreased, to the rest scan line, in the aging period.

The scan driver applies a multilevel aging voltage, which is sequentially increased and then decreased, to any one of an odd-numbered scan line and an even-numbered scan line, and applies a multilevel aging voltage, which is sequentially decreased and then increased, to the rest scan line, in the aging period.

The scan driver applies a multilevel aging voltage, which is sequentially increased or decreased, to any one of an odd-numbered scan line and an even-numbered scan line, and applies a definite voltage to the rest scan line, in the aging period.

The scan driver applies a multilevel aging voltage, which is sequentially increased and then decreased or sequentially decreased and then increased, to any one of an odd-numbered scan line and an even-numbered scan line, and applies a definite voltage to the rest scan line, in the aging period.

The definite voltage applied in the aging period is a voltage identical to a lowest aging voltage of the multilevel aging voltage.

The definite voltage applied in the aging period is identical to a low scan voltage supplied as an enable voltage to the scan line in the scan period.

The scan driver further includes a neutralization step, in which the same aging voltage is applied to the odd-numbered and the even-numbered scan lines.

The scan driver applies the same middle voltage of the multilevel aging voltage to the odd-numbered and the even-numbered scan lines in the neutralization step.

The scan driver supplies the multilevel aging voltage in which a voltage between a highest aging voltage, larger than a high scan voltage supplied as a disable voltage to the scan line or equal to the high scan voltage, and a lowest aging voltage, equal to a low scan voltage supplied as an enable voltage, is divided into a multilevel, in the scan period.

The scan driver repeats the multilevel aging voltage in the aging period to supply it.

The scan driver repeats the scan period and the aging period for each frame.

The scan driver includes: a shift register having a plurality of stages to shift a start pulse to supply it as each of output signals and a start pulse of next stage, and a plurality of dummy stages to shift an output signal of the last stage in the stages to secure the aging period; and a level shifter part having a plurality of level shifters to level-shift each of the output signals of the shift register to supply the scan pulse to the scan line in the scan period and to supply a multilevel aging voltage to the adjacent scan lines to have the multilevel voltage difference in the aging period.

The scan driver includes: a shift register having a plurality of stages to shift a start pulse to supply it as each of output signals and a start pulse of next stage; and a level shifter part having a plurality of level shifters to level-shift each of the output signals of the shift register to supply the scan pulse to the scan line in the scan period and to supply a multilevel aging voltage to the adjacent scan lines to have the multilevel voltage difference in the aging period.

The start pulse of the next stage is delayed to be supplied to include the aging period next the scan period.

Each of the stages supplies an enable signal corresponding to the shifted start pulse, and wherein the level shifter part synchronizes the aging period with a period, when the enable signal is outputted in the each dummy stage, to change the multilevel aging voltage.

An apparatus of driving an electro-luminescence display panel, according to the present invention includes: an organic electro-luminescence display panel having electro-luminescence cells formed at a cross of both a scan line and a data line; a scan driver to supply a scan pulse to the scan line during a scan period and to float the scan line during an aging period directly after the scan period; a data driver to apply a data signal to the data line during the scan period; and an aging voltage supplier to apply voltages different from each other to adjacent data lines during the aging period to make a self-aging is performed in the organic electro-luminescence display panel.

The apparatus further includes a switch connected to the data line and connected between the data driver and the aging voltage supplier to switch the data signal and the aging voltage, which are supplied to the data line.

The aging voltage is any one of: a first voltage, which is supplied to a ith sub-pixel; a second voltage, which is supplied to sub-pixels adjacent to the ith sub-pixel and is different from the first voltage; and a third voltage, which is formed by floating the data line.

The aging voltage is repeatedly applied for each pixel including each of sub-pixels.

BRIEF DESCRIPTION OF THE DRAWINGS

These and other objects of the invention will be apparent from the following detailed description of the embodiments of the present invention with reference to the accompanying drawings, in which:

FIG. 24 is a view showing a state of a voltage supplied to each data line in an aging period of the seventh embodiment of the present invention.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 3 to 25.

Figure 1:
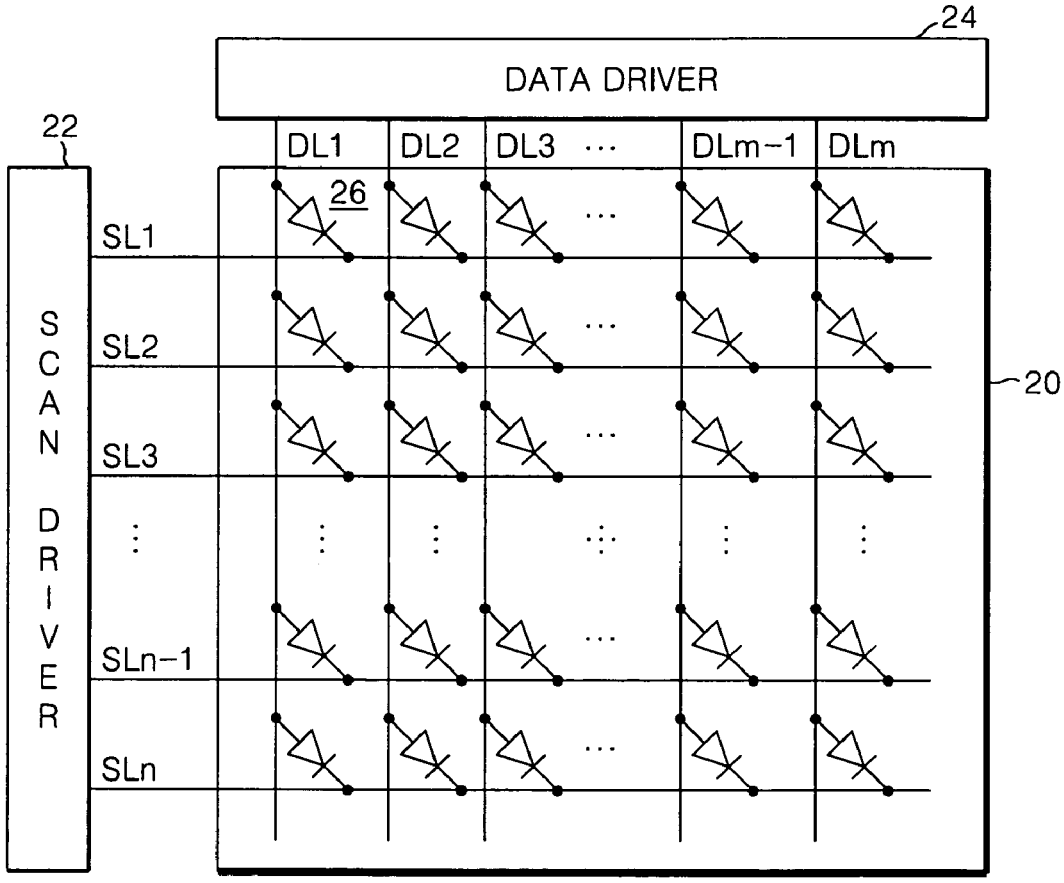
FIG. 1 RELATED ART
FIG. 1 is a circuit diagram showing equivalently a related art passive matrix type organic EL display device.
Figure 2:
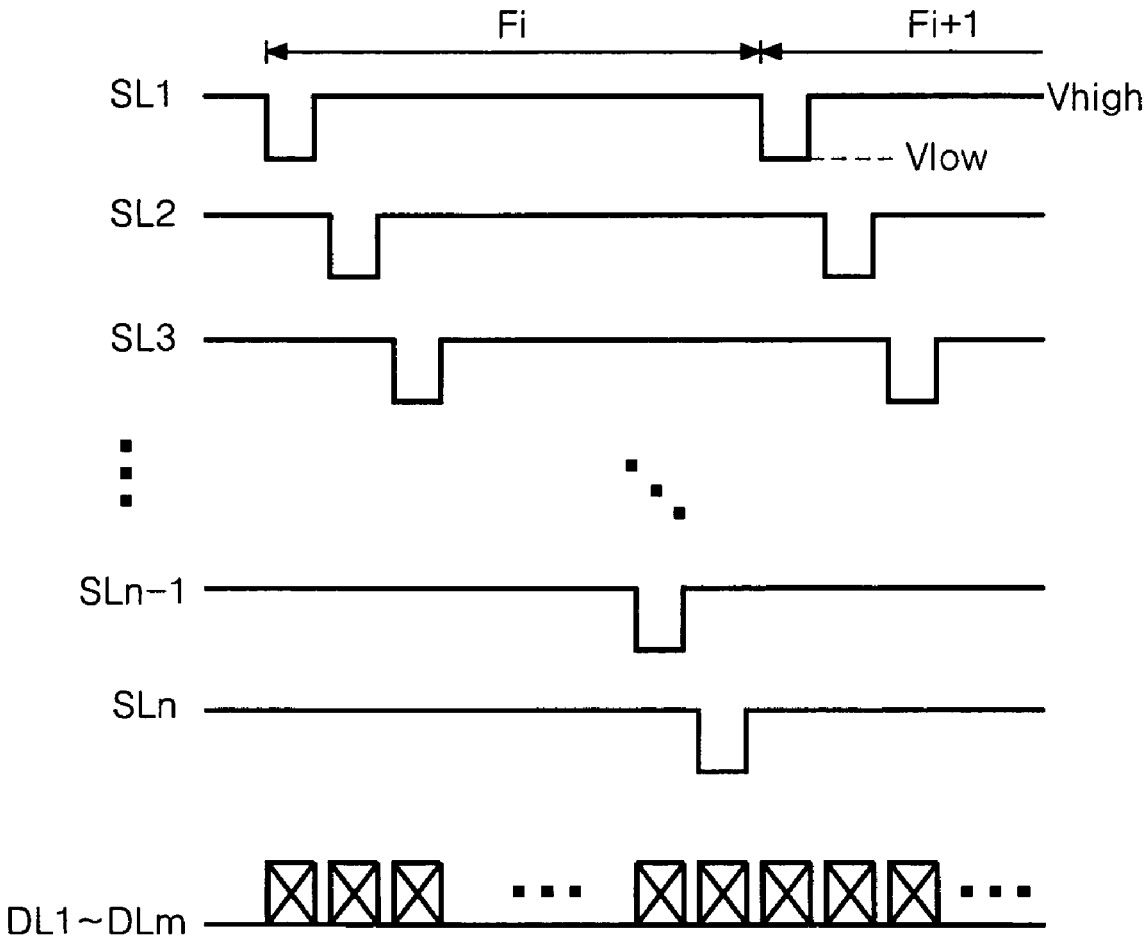
FIG. 2 RELATED ART
FIG. 2 is a driving waveform diagram of an EL panel shown in FIG. 1.
Figure 3:
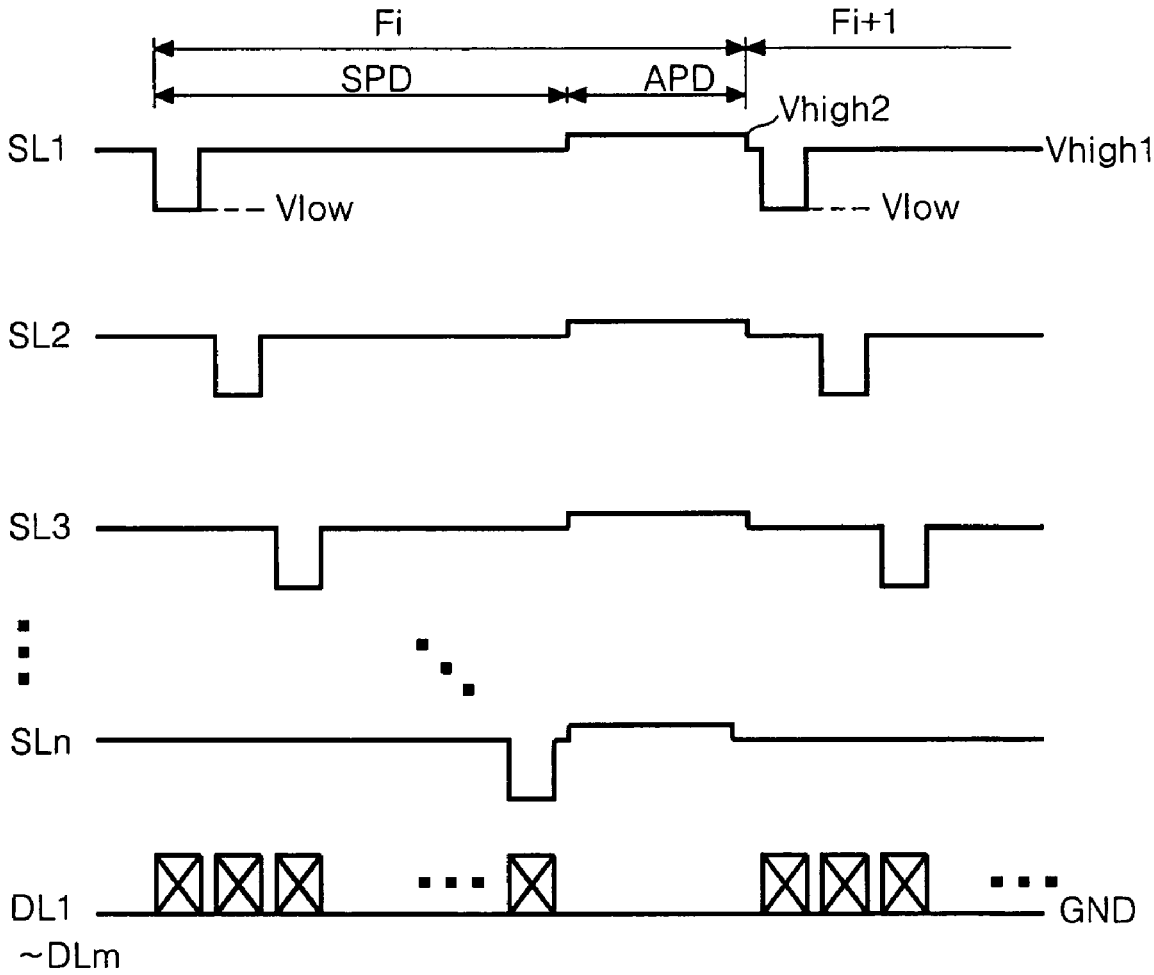
FIG. 3 is a driving waveform diagram for describing a method of driving an organic EL display panel according to the present invention.

FIG. 3 is a driving waveform diagram of a scan line and a data line in accordance with a method of driving an organic EL display panel according to the present invention.

In an aging period APD of the method of driving the organic EL display panel according to the embodiment of the present invention, a high voltage, i.e., a second high scan voltage Vhigh2, is supplied to a n number of scan lines SL1 to SLn, and a low voltage, i.e., a ground voltage GND, is supplied to a m number of data lines DL1 to DLm. In this case, in order to raise an aging efficiency, the high scan voltage Vhigh2 is a voltage larger than the first high scan high voltage Vhigh1 supplied in a light-emitting period LPD. For instance, the second high scan voltage Vhigh2 is set as a larger voltage as much as about 10% to 20% than the first scan high voltage Vhigh1.

As set forth above, in the method of driving the organic EL display device according to the embodiment of the present invention, the aging period APD to make an entire EL cells to be a reverse bias state is secured to thereby do an aging of the EL panel upon driving. Accordingly, it is possible to extend a life-span of the EL panel and to prevent badness such as line defect caused by a stress.

Figure 4:
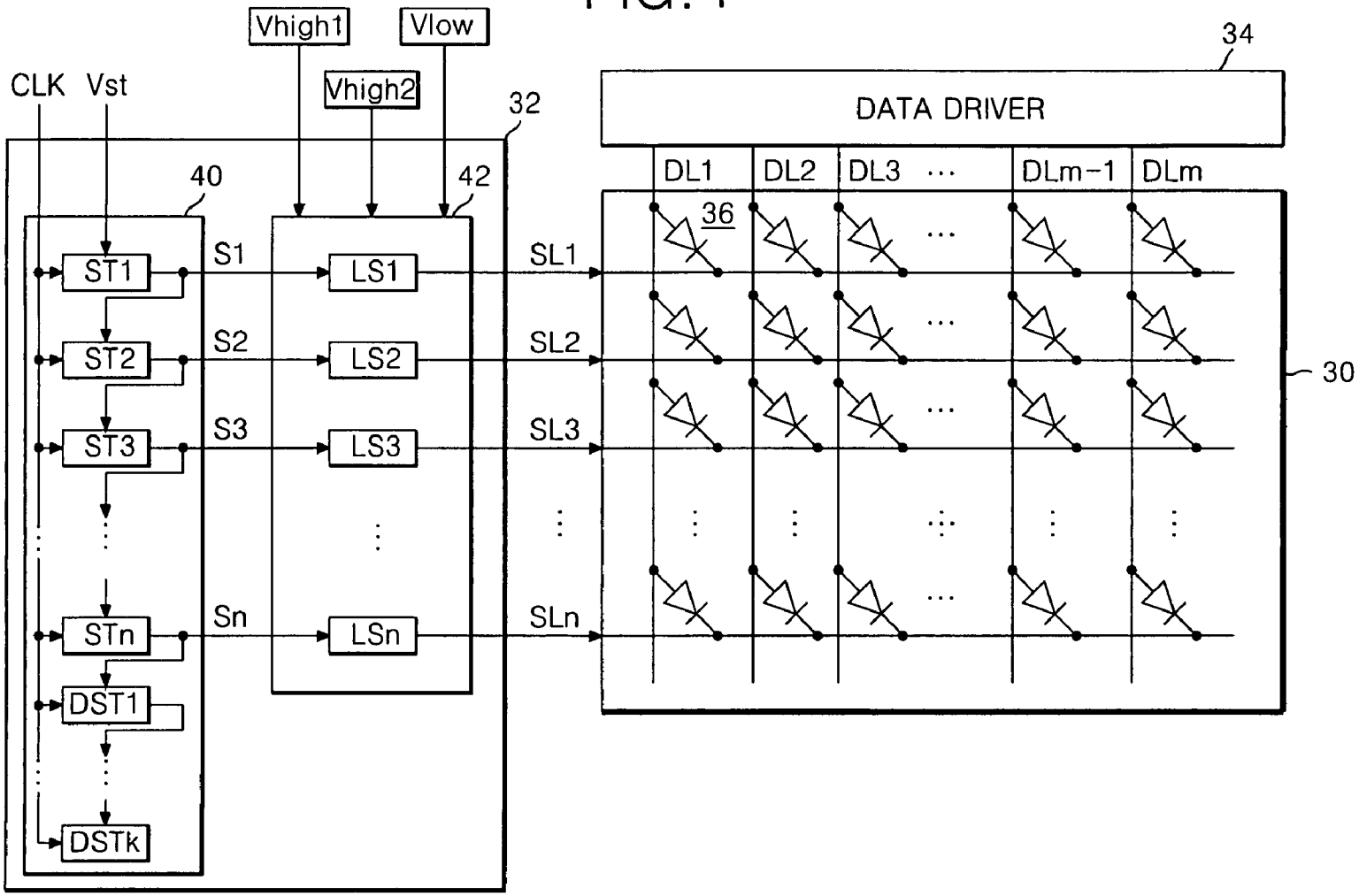
FIG. 4 is a block diagram showing an apparatus of driving an organic EL display panel according to a first embodiment of the present invention.
Figure 5:
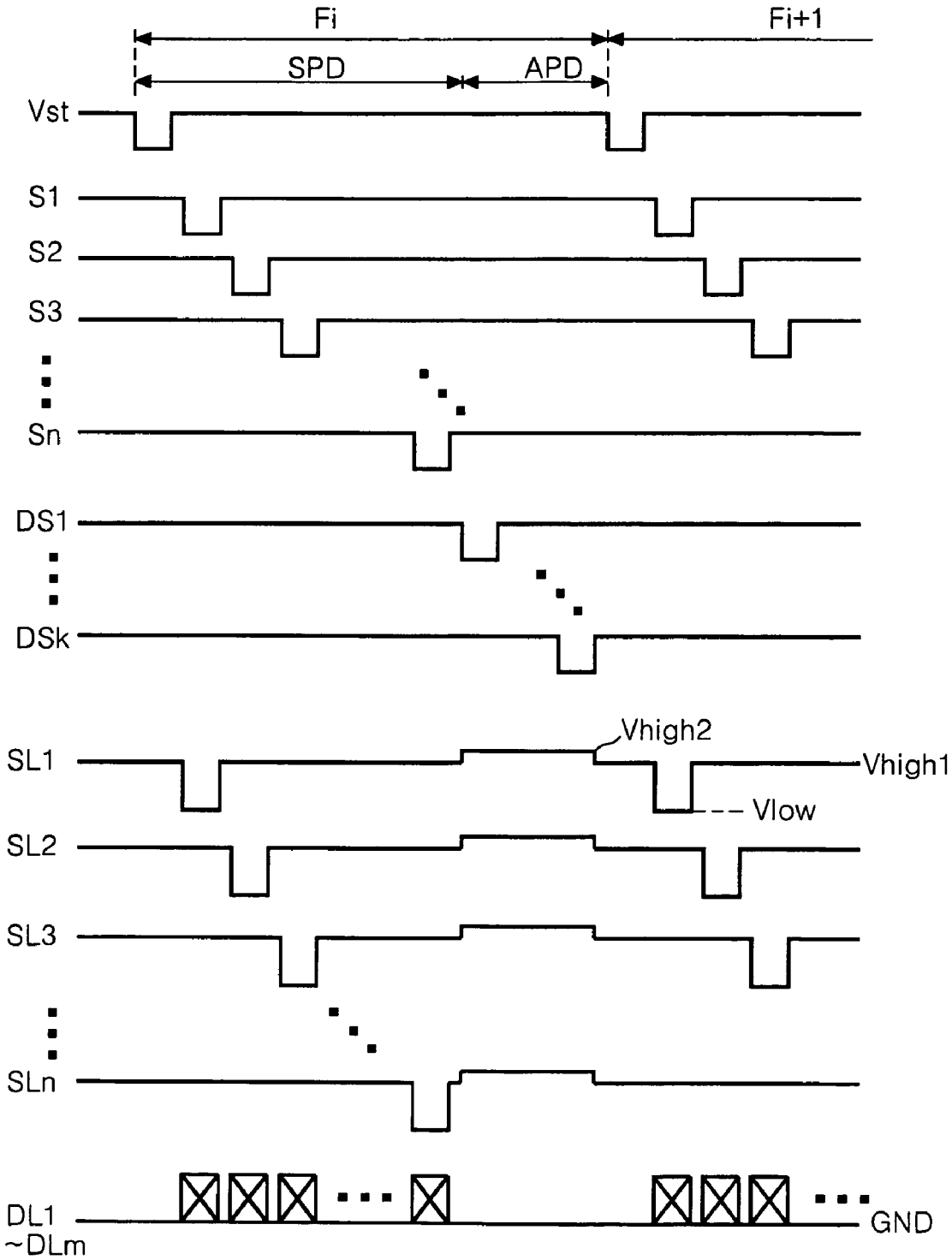
FIG. 5 is a driving waveform of the apparatus of driving the organic EL display panel shown in FIG. 4.

FIG. 4 is a block diagram showing an apparatus of driving an organic EL display panel according to a first embodiment of the present invention, and FIG. 5 is a driving waveform of the apparatus of driving the organic EL display panel shown in FIG. 4.

The apparatus of driving the EL display panel shown in FIG. 4 includes: an EL panel 30 having an EL cell 36 formed at a cross of both scan lines SL1 to SLn and data lines DL1 to DLm; a scan driver 32 for driving the scan lines SL1 to SLn; and a data driver 34 for driving the data lines DL1 to DLm.

The scan driver 32, as shown in FIG. 5, sequentially supplies a low scan voltage Vlow to a n number of scan lines SL1 to SLn in a scan period SPD of a frame Fi, and supplies a high scan voltage Vhigh in the rest period. Further, the scan driver 32 supplies a second high scan voltage Vhigh2, larger than the first high scan voltage Vhigh1, to all of the n number of scan lines SL1 to SLn, in an aging period of one frame Fi.

For this, the scan driver 32 includes: a shift register 40, which outputs a n number of output signals S1 to Sn as sequentially shifting a start pulse Vst inputted by a frame Fi unit, and makes to secure an aging period APD; and a level shifter part 42 to level-shift each of output signals Si to Sn of the shigt register 40 to supply it to each of scan lines SL1 to SLn.

The shift register 40 includes: a n number of stages ST1 to STn for outputting the n number of output signals S1 to Sn as shifting the start pulse; and a k number of dummy stages DST1 to DSTk to make to secure the aging period APD as shifting the output signal Sn of the nth stage STn.

The n number of stages ST1 to STn and the k number of dummy stages DST1 to DSTk are connected, in series, to an input line of the start pulse Vst, and are commonly connected to an input line of a clock signal CLK. The first to the nth stage ST1 to STn sequentially shift the start pulse Vst in accordance with the clock signal CLK to output the first to the nth output signal S1 to Sn to the level shifter part 42 as shown in FIG. 5. In this case, each of the output signals S1 to Sn of the n number of stages ST1 to STn is supplies to an input line of a start pulse of a next stage. The k number of dummy stages DST1 to DSTk sequentially shift the output signal Sn of the nth stage STn in accordance with the clock signal CLK. Each of the output signals DS1 to DSk of the k number of dummy stages DST1 to DSTk is not outputted to the level shifter part 42 and is supplies to an input line of a start pulse of a next dummy stage. Accordingly, each frame Fi, as shown in FIG. 5, becomes secure a dummy period, when the dummy stages DST1 to DSTk sequentially output the output signals DS1 to DSk of a low voltage, as an aging period, separately from the scan period SPD, when the first to the nth stage ST1 to STn output the output signals S1 to Sn of a low voltage. During the aging period, the entire first to the nth stage ST1 to STn output the output signals S1 to Sn of a high voltage.

The level shifter part 42 includes a n number of level shifters LS1 to LSn, which are respectively connected between the n number of stages ST1 to STn and the n number of scan lines SL1 to SLn. If the level shifters LS1 to LSn, as shown in FIG. 5, are supplied with the low voltage of the output signals S1 to Sn from the shift register 40 in the scan period SPD, then the level shifters LS1 to LSn select a low scan voltage Vlow, whereas, if the level shifters LS1 to LSn are supplied with the high voltage of the output signals S1 to Sn from the shift register 40 in the scan period SPD, then the level shifters LS1 to LSn select a first high scan voltage Vhigh1. Accordingly, the level shifters LS1 to LSn supply the selected voltages to each of the scan lines SL1 to SLn. Further, if the level shifters LS1 to LSn, as shown in FIG. 5, are supplied with the high voltage of the output signals S1 to Sn from the shift register 40 in the aging period APD, then the entire level shifters LS1 to LSn select a second high scan voltage Vhigh2 to supply the selected second high scan voltage Vhigh2 to each of the scan lines SL1 to SLn.

To this end, as shown in FIG. 4, the first and the second high scan voltages Vhigh1 and Vhigh2 together with the low scan voltage Vlow are respectively generated in power source and then are inputted to the level shifter part 42 via power lines different from each other. In this case, each of the level shifters LS1 to LSn selects any one of the low scan voltage Vlow and the high scan voltages Vhigh1 and Vhigh2 in accordance with the output signals S1 to Sn of the shift register 40 to output the selected voltage, and selects any one of the low scan voltage Vlow and the high scan voltages Vhigh1 and Vhigh2 in accordance with the scan period SPD and aging period APD to output the selected voltage.

Differently from this, the second high scan voltage Vhigh2 and the low scan voltage Vlow are respectively generated in the power source and then are inputted to the level shifter part 42. In this case, each of the level shifters LS1 to LSn selects the high scan voltage Vhigh2 in a case of the aging period APD to output it. Whereas, in a case of the scan period SPD, each of the level shifters LS1 to LSn voltage-drops the second high scan voltage Vhigh2 to the first high scan voltage Vhigh1 with an aid of a resistance, and then selects any on of the first high scan voltage Vhigh1 and the low scan voltage Vlow to output it.

The data driver 34 supplies a data signal to a m number of data lines DL1 to DLm for each period when the scan lines are enabled in the scan period SPD, and supplies a low voltage, e.x, a ground voltage GND, in the aging period APD.

Each of the EL cells 36 formed in the EL panel 30 is represented as a diode, which is connected in a forward direction between the data line DL and the scan line SL. Herein, the data line DL is equivalently an anode and the scan line SL is equivalently a cathode. If a low scan voltage Vlow, is supplied to the scan line SL and a positive data signal(current) is supplied to the data line DL to apply a forward voltage to each EL cell 36, then each EL cell 36 emits light to generate light corresponding to the data signal. On the other hand, if high scan voltages Vhigh1 and Vhigh2 are supplied to the scan line SL to thereby apply a reverse voltage to each EL cell 36, then each EL cell 36 does not emit light. Especially, if the second high scan voltage is supplied to the entire scan lines SL1 to SLn and the low voltage is supplied to the entire data lines DL1 to DLm in the aging period, then each of the EL cells 36 becomes a reverse bias state for the aging. Accordingly, it is possible to extend a life-span of the EL panel 30 and to prevent badness such as line defect.

Figure 6:
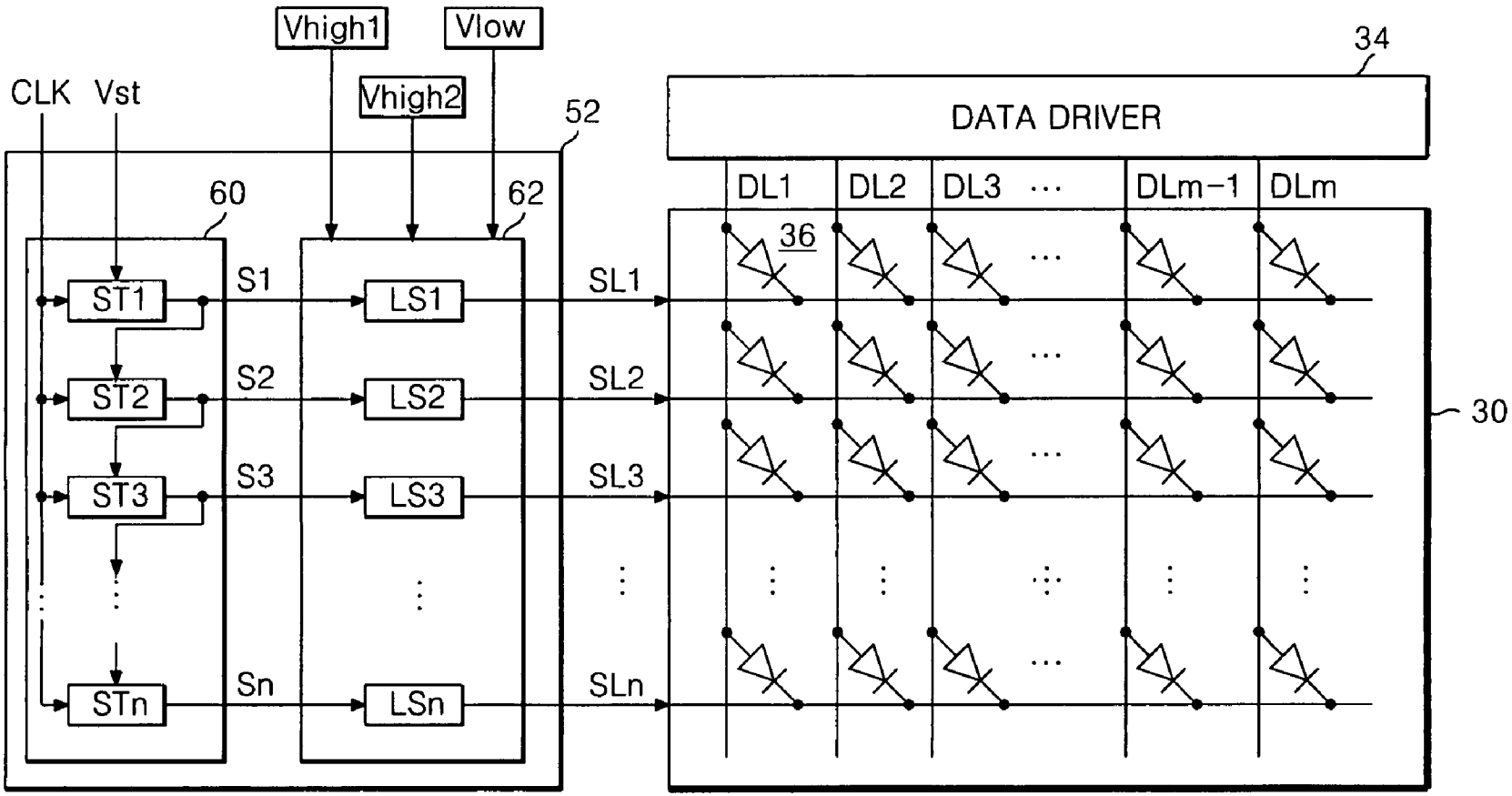
FIG. 6 is a block diagram showing an apparatus of driving an organic EL display panel according to a second embodiment of the present invention.
Figure 7:
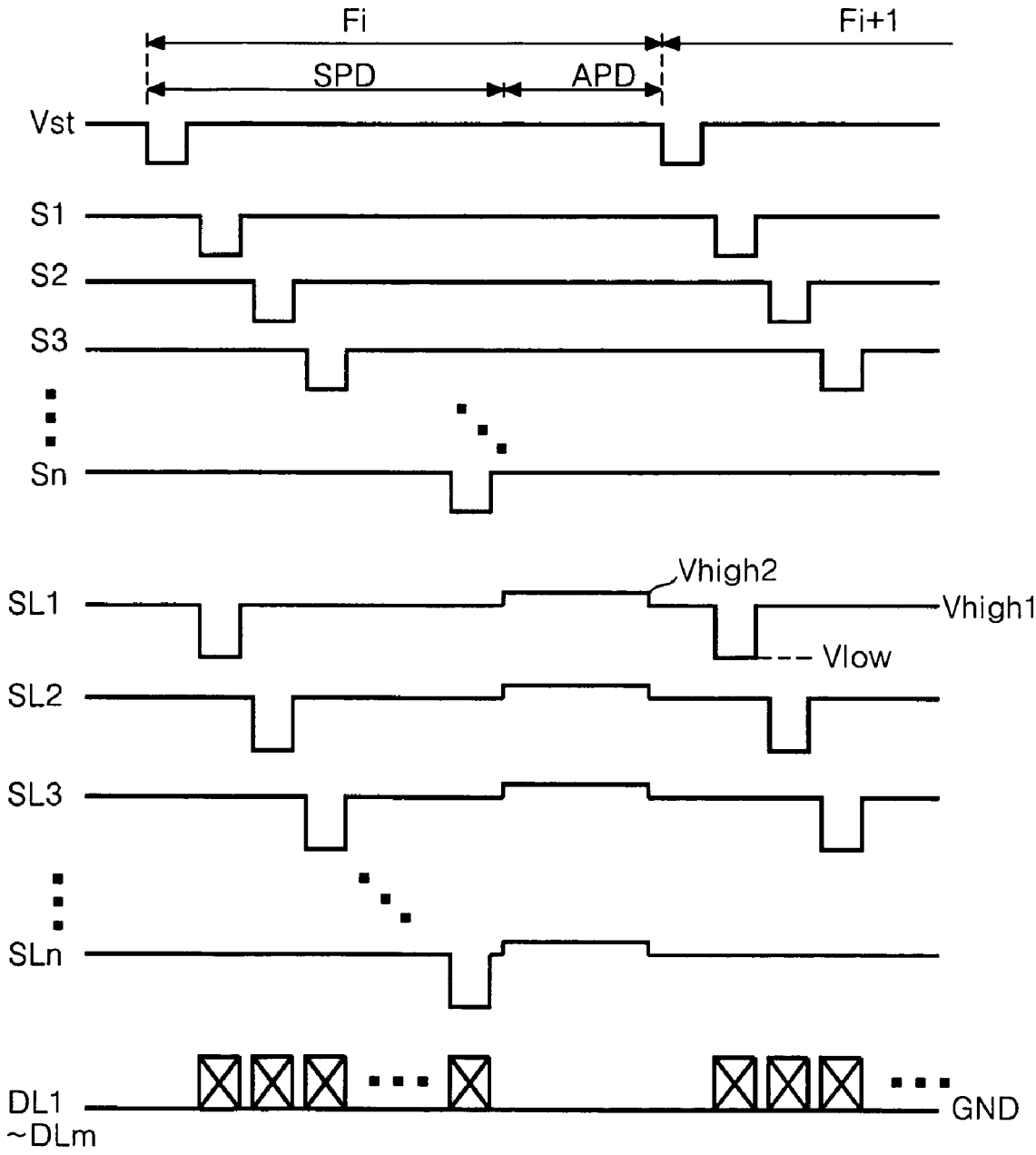
FIG. 7 is a driving waveform of the apparatus of driving the organic EL display panel shown in FIG. 6.

FIG. 6 is a block diagram showing an apparatus of driving an organic EL display panel according to a second embodiment of the present invention, and FIG. 7 is a driving waveform of the apparatus of driving the organic EL display panel shown in FIG. 6.

The apparatus of driving the organic EL display panel shown in FIG. 6 has composition elements identical to those of the apparatus of driving the organic EL display panel shown in FIG. 4 except that a shift register 60 of a scan driver 52 has only n number of stages ST1 to STn without a dummy stage DST. Therefore, a description on the identical composition elements will be omitted.

The scan driver 52 includes: a shift register 60, which outputs a n number of output signals S1 to Sn as sequentially shifting a start pulse Vst inputted by a frame Fi unit; and a level shifter part 62 to level-shift each of output signals S1 to Sn of the shigt register 60 to supply it to each of scan lines SL1 to SLn.

The n number of stages ST1 to STn included in the shift register 60 sequentially shift the start pulse Vst in accordance with a clock signal CLK to output the first to the nth output signals S1 to Sn to the level shifter 62 as shown in FIG. 7. The output signals S1 to Sn are respectively supplied to an input line of a start pulse of a next stage. Accordingly, as shown in FIG. 7, the first to the nth stages ST1 to STn sequentially output the output signals S1 to Sn of a low voltage. To secure an aging period APD next a scan period SPD, a point of supply time of the start pulse Vst in a next frame Fi+1 is delayed. During the aging period APD, the entire first to nth stages ST1 to STn output the output signals S1 to Sn of a high voltage.

If a n number of level shifters LS1 to LS included in the level shifter part 62, as shown in FIG. 7, are supplied with the low voltage of the output signals S1 to Sn from the shift register 60 in the scan period SPD, then the level shifters LS1 to LSn select a low scan voltage Vlow, whereas, if the level shifters LS1 to LSn are supplied with the high voltage of the output signals S1 to Sn from the shift register 60 in the scan period SPD, then the level shifters LS1 to LSn select a first high scan voltage Vhigh1. Accordingly, the level shifters LS1 to LSn supply the selected voltages to each of the scan lines SL1 to SLn. Further, if the level shifters LS1 to LSn, as shown in FIG. 7, are supplied with the high voltage of the output signals S1 to Sn from the shift register 60 in the aging period APD, then the entire level shifters LS1 to LSn select a second high scan voltage Vhigh2 to supply the selected second high scan voltage Vhigh2 to each of the scan lines SL1 to SLn.

Accordingly, if the second high scan voltage Vhigh2 is supplied to the entire scan lines SL1 to SLn and the low voltage is supplied to the entire data lines DL1 to DLm in the aging period APD, then each of the EL cells 36 becomes a reverse bias state. Accordingly, an aging is performed in the EL cells 36. Thus, it is possible to extend a life-span of the EL panel 30 and to prevent badness such as line defect.

Figure 8:
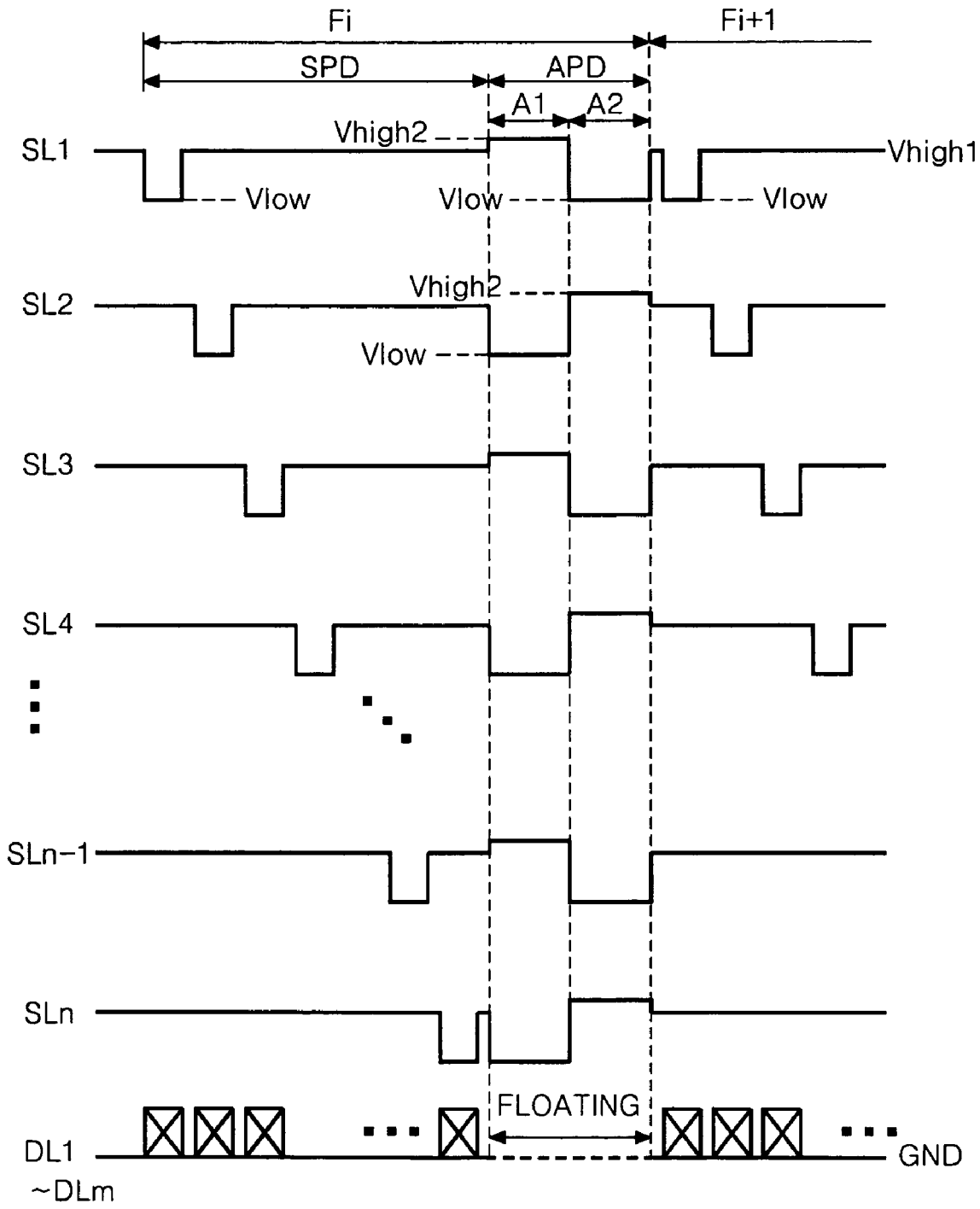
FIG. 8 is a driving waveform diagram for describing a method of driving the organic EL display panel according to the present invention.

FIG. 8 shows a driving waveform of both a scan line and a data line in accordance with the method of driving the organic EL display panel according to the embodiment of the present invention.

The method of driving the organic EL display panel according to the embodiment of the present invention includes an aging period APD when an aging is performed in the EL panel upon driving. For instance, as shown in FIG. 8, a frame Fi includes a scan period SPD for line-sequentially emitting EL cells and an aging period APD to make a self-aging is performed in the EL cells by a voltage difference of adjacent two scan lines. To this end, a period of the frame Fi becomes increased to secure the aging period APD separately from the scan period SPD.

In one frame Fi, a negative scan pulse, i.e., a low scan voltage Vlow, is sequentially supplied to the n number of scan lines SL1 to SLn during the scan period SPD, and a first high scan voltage Vhigh1 is supplied during the rest period. Further, a positive data signal, e.x., a current, is supplied to a m number of data lined DL1 to DLm for each period when the low scan voltage Vlow is supplied. Accordingly, the EL cells, to which a forward voltage is applied by the low scan voltage Vlow and the positive data signal, emit to generate light corresponding to the data signal. On the other hand, EL cells 36, to which a reverse voltage is applied by the first high scan voltage Vhigh1, do not emit light.

In the aging period APD next the scan period SPD, each of the scan lines SL1 to SLn has a voltage difference with an adjacent scan line to make a self-aging of the EL cells. In other words, aging voltages opposite to each other are applied to an odd-numbered scan line and an even-numbered scan line during the aging period APD, so that an odd-numbered scan line and an even-numbered scan lines have a voltage difference to each other and the data lines DL1 to DLm become a floating state. Accordingly, an optional voltage is applied to each of the EL cells in accordance with state of the EL cell, so that a self-aging is performed in each of the EL cells.

For instance, as shown in FIG. 8, as the data lines DL1 to DLm are floated, a second high scan voltage Vhigh, i.e., a high aging voltage, is applied to the odd-numbered scan lines SL1, SL3, . . . , SLn-1, whereas, a low scan voltage Vlow, i.e., a low aging voltage, is applied to the even-numbered scan lines SL2, SL4, . . . , SLn. Or, the low scan voltage Vlow is applied to the odd-numbered scan lines SL1, SL3, . . . , SLn-1, and the second high scan voltage Vhigh2 is applied to the even-numbered scan lines SL2, SL4, . . . , SLn. Accordingly, a self-aging is performed in the EL cells by a voltage difference between adjacent scan lines. Herein, the second high scan voltage Vhigh2, i.e., the high aging voltage, is set to be larger than the first high scan voltage Vhigh1 applied during the scan period SPD or to be equal to the first high scan voltage Vhigh1. For instance, the second high scan voltage Vhigh2 is set as a larger voltage as much as about 10% to 20% than the first scan high voltage Vhigh1.

Furthermore, in order to raise an aging efficiency, an aging voltage, supplied to each of the scan lines SL1 to SLn in the same aging period APD, is set to be reversed at least one time.

For instance, as shown in FIG. 8, the aging period APD is divided into first and second periods A1 and A2. When the second high scan voltage Vhigh2 is applied to the odd-numbered scan lines SL1, SL3, . . . , SLn-1 and the low scan voltage Vlow is applied to the even-numbered scan lines SL2, SL4, . . . , SLn, during the first period A1, the voltage is reversed during the second period A2 to apply the low scan voltage to the odd-numbered scan lines SL1, SL3, . . . , SLn-1 and to apply the second high scan voltage Vhigh2 to the even-numbered scan lines SL2, SL4, . . . , SLn.

As described above, the method of driving the organic EL display device according to the embodiment of the present invention secure the aging period APD when the self-aging is performed in the entire EL cells in one frame Fi to enable to do self-aging of the EL panel upon driving. Accordingly, it is possible to extend a life-span of the EL panel and to prevent badness such as line defect caused by a stress.

Figure 9:
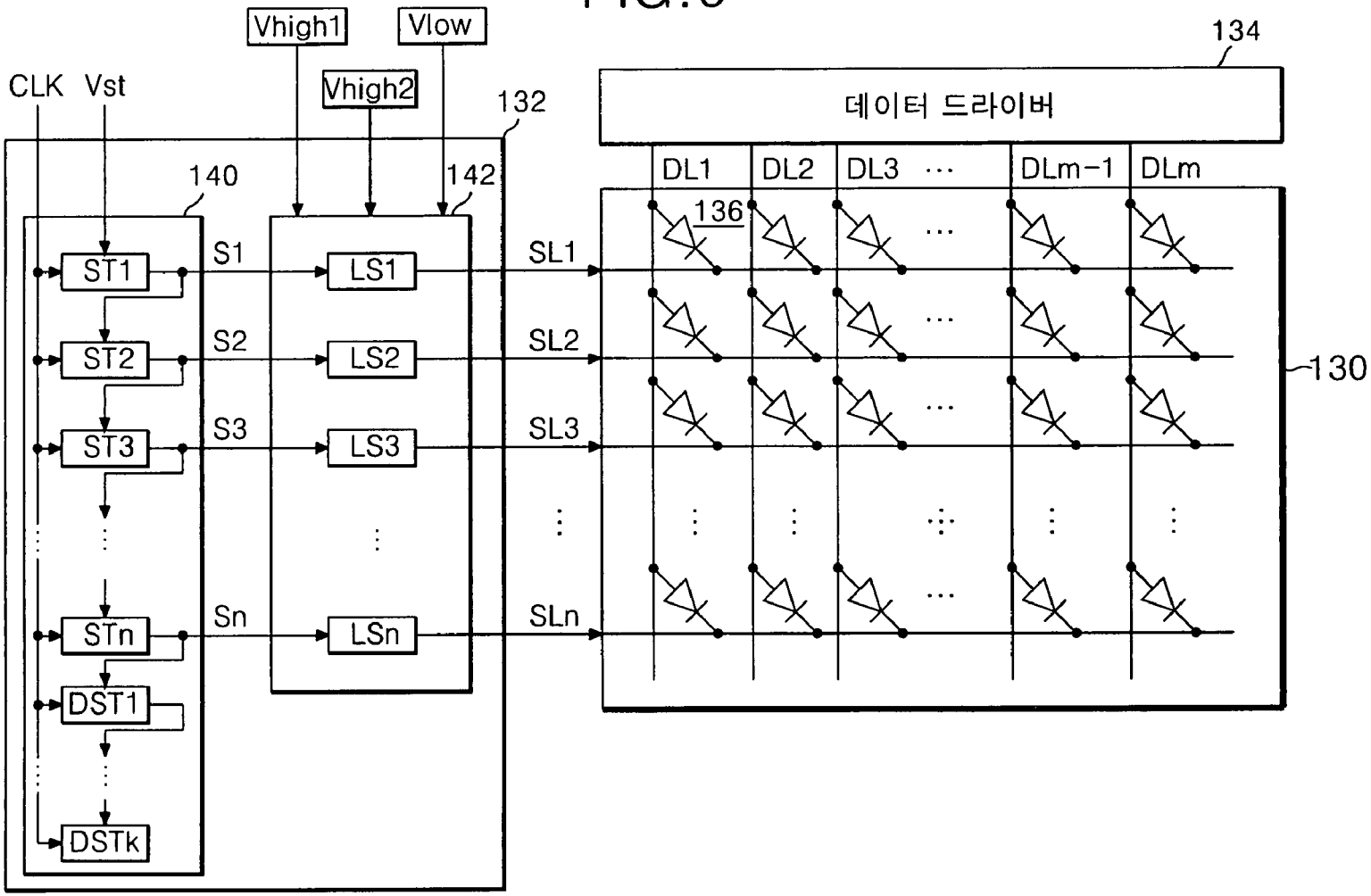
FIG. 9 is a block diagram showing an apparatus of driving an organic EL display panel according to a third embodiment of the present invention.
Figure 10:
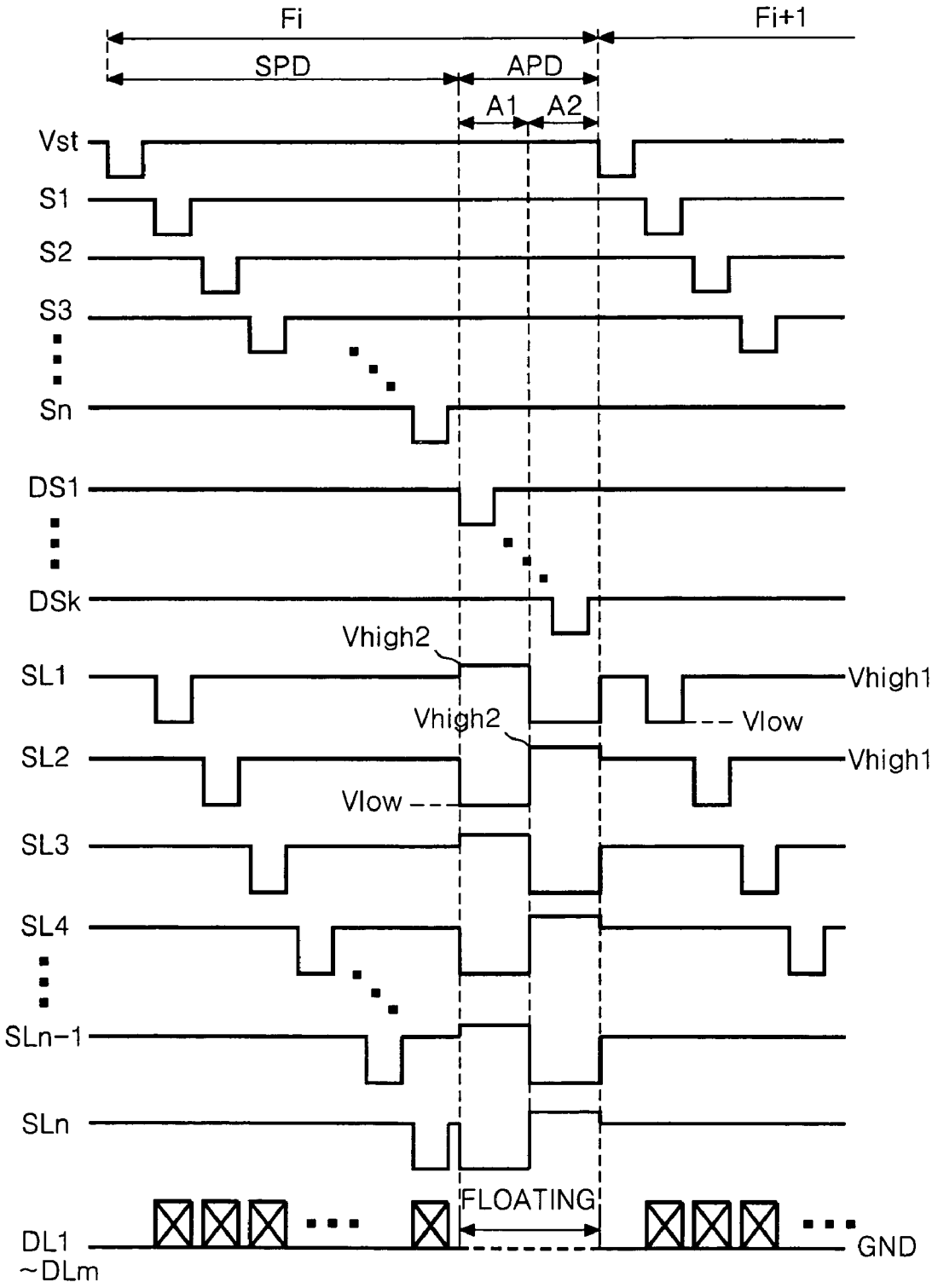
FIG. 10 is a driving waveform of the apparatus of driving the organic EL display panel shown in FIG. 9.
Figure 11:
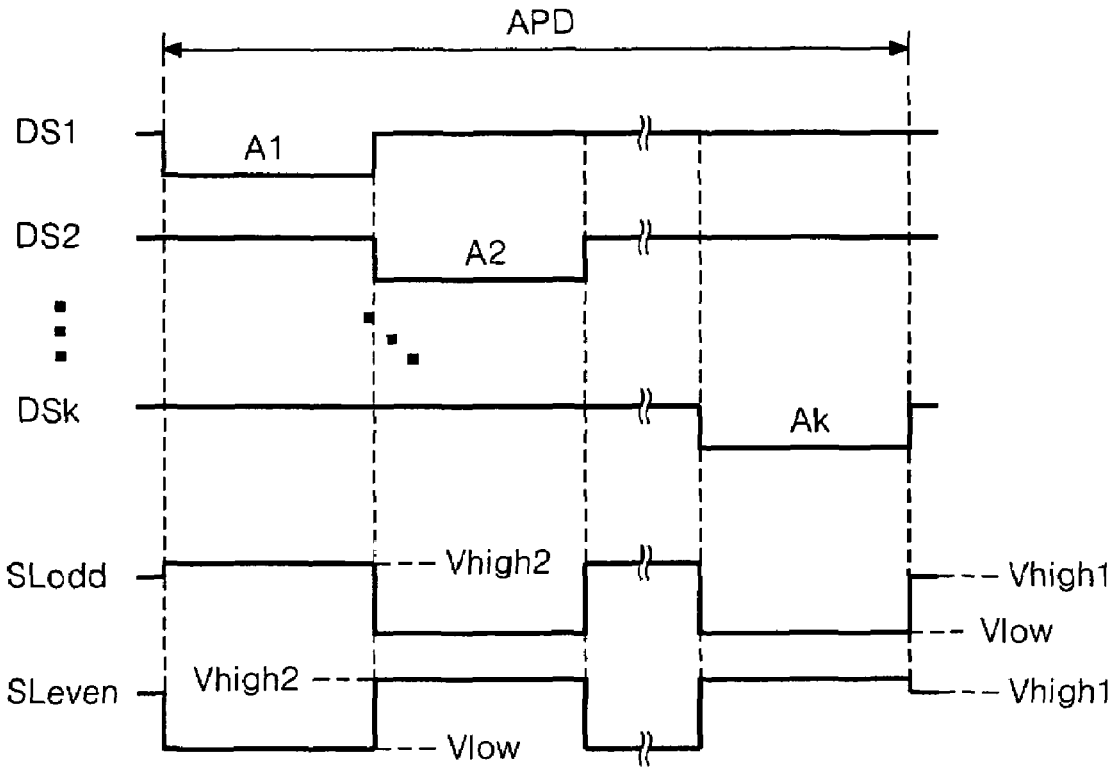
FIG. 11 is a driving waveform of a scan driver shown in FIG. 9 in an aging period.
Figure 12:
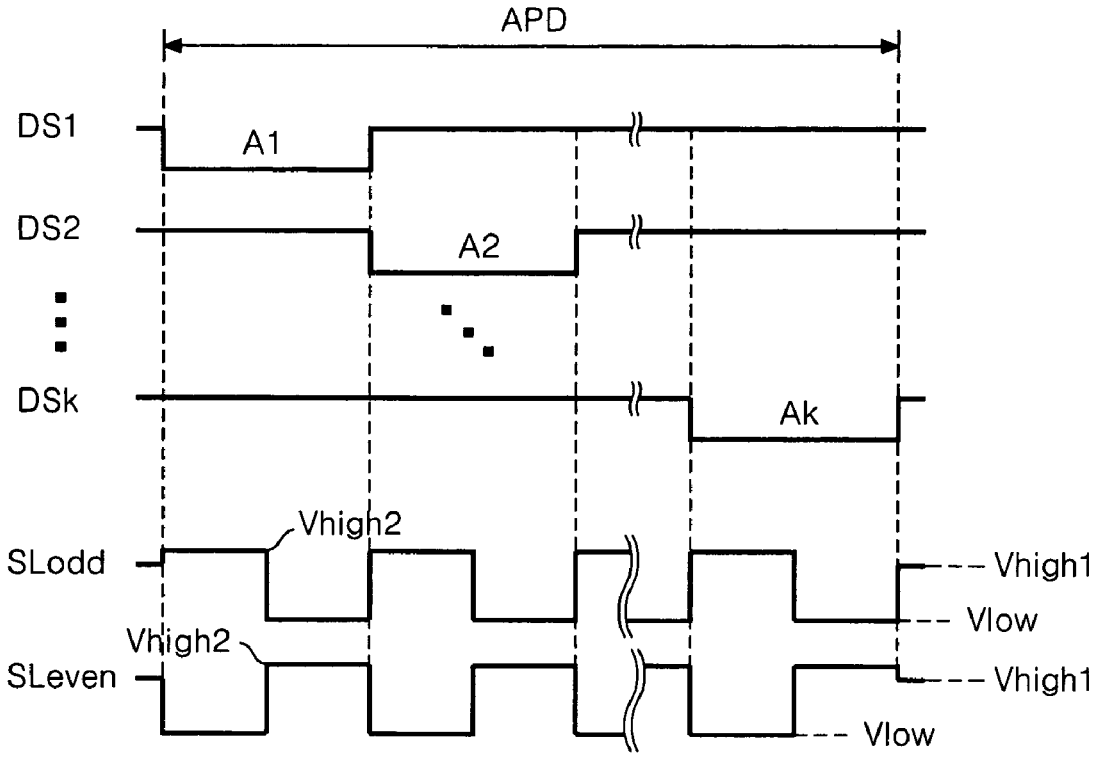
FIG. 12 is another driving waveform of the scan driver shown in FIG. 9 in the aging period.

FIG. 9 is a block diagram showing an apparatus of driving an organic EL display panel according to a third embodiment of the present invention, FIG. 10 is a driving waveform of the apparatus of driving the organic EL display panel shown in FIG. 9, and FIGS. 11 and 12 are driving waveforms of a scan driver shown in FIG. 9 in an aging period APD.

The apparatus of driving the EL display panel shown in FIG. 9 includes: an EL panel 130 having an EL cell 136 formed at a cross of both scan lines SL1 to SLn and data lines DL1 to DLm; a scan driver 132 for driving the scan lines SL1 to SLn; and a data driver 134 for driving the data lines DL1 to DLm.

Each of the EL cells 136 formed in the EL panel 130 is represented as a diode, which is connected in a forward direction between the data line DL and the scan line SL. Herein, the data line DL is equivalently an anode and the scan line SL is equivalently a cathode. If a low scan voltage Vlow is supplied to the scan line SL and a positive data signal(current) is supplied to the data line DL to apply a forward voltage to each EL cell 136 in a scan period SPD, then each EL cell 136 emits light to generate light corresponding to the data signal. On the other hand, if a first high scan voltage Vhigh1 is supplied to the scan line SL to thereby apply a reverse voltage to each EL cell 136, then each EL cell 136 does not emit light. Further, If the data lines DL1 to DLn are floated, and voltages opposite to each other are applied to the odd-numbered scan lines SL1, SL3, . . . , SLn-1 and the even-numbered scan lines SL2, SL4, . . . , SLn, in the aging period APD, then the each of the EL cells 136 does not emit light and a self-aging is performed in the each of the EL cells 136.

The data driver 134 supplies a data signal to the m number of data lines DL1 to DLm for each period when the scan lines SL1 to SLn are enabled during the scan period SPD, and the data driver 124 floats the data lines DL1 to DLm during the aging period APD.

The scan driver 132, as shown in FIG. 10, sequentially supplies a low scan voltage Vlow to the n number of scan lines SL1 to SLn in a scan period SPD of one frame Fi, and supplies a high scan voltage Vhigh in the rest period. Further, the scan driver 132 supplies aging voltages opposite to each other to the odd-numbered scan lines SL1, SL3, . . . , SLn-1 and the even-numbered scan lines SL2, SL4, . . . , SLn in the aging period APD of one frame Fi.

For this, the scan driver 132 includes: a shift register 140, which outputs a n number of output signals S1 to Sn as sequentially shifting a start pulse Vst inputted by a frame Fi unit, and makes to secure an aging period APD; and a level shifter part 142 to level-shift each of output signals Si to Sn of the shift register 140 to supply it to each of scan lines SL1 to SLn.

The shift register 140 includes: a n number of stages ST1 to STn for outputting the n number of output signals Si to Sn as shifting the start pulse; and a k number of dummy stages DST1 to DSTk to make to secure an aging period APD as shifting the output signal Sn of the nth stage STn.

The n number of stages ST1 to STn and the k number of dummy stages DST1 to DSTk are connected, in series, to an input line of the start pulse Vst, and are commonly connected to an input line of a clock signal CLK. The first to the nth stage ST1 to STn sequentially shift the start pulse Vst in accordance with the clock signal CLK to output the first to the nth output signal S1 to Sn to the level shifter part 142 as shown in FIG. 10. In this case, each of the output signals S1 to Sn of the n number of stages ST1 to STn is supplies to an input line of a start pulse of a next stage. The k number of dummy stages DST1 to DSTk sequentially shift the output signal Sn of the nth stage STn in accordance with the clock signal CLK. Each of the output signals DS1 to DSk of the k number of dummy stages DST1 to DSTk is not outputted to the level shifter part 142 and is supplies to an input line of a start pulse of a next dummy stage. Accordingly, each frame Fi, as shown in FIG. 10, becomes secure a dummy period, when the dummy stages DST1 to DSTk sequentially output the output signals DS1 to DSk of a low voltage, as an aging period, separately from the scan period SPD, when the first to the nth stages ST1 to STn output the output signals S1 to Sn of a low voltage. During the aging period APD, the entire first to the nth stage ST1 to STn output the output signals S1 to Sn of a high voltage.

The level shifter part 142 includes a n number of level shifters LS1 to LSn, which are respectively connected between the n number of stages ST1 to STn and the n number of scan lines SL1 to SLn. If the level shifters LS1 to LSn, as shown in FIG. 10, are supplied with the low voltage, i.e., an enable voltage of the output signals S1 to Sn from the shift register 140, in the scan period SPD, then the level shifters LS1 to LSn select a low scan voltage Vlow, whereas, if the level shifters LS1 to LSn are supplied with the high voltage of the output signals S1 to Sn from the shift register 140 in the scan period SPD, then the level shifters LS1 to LSn select a first high scan voltage Vhigh1. Accordingly, the level shifters LS1 to LSn supply the selected voltages to each of the scan lines SL1 to SLn. Further, if the level shifters LS1 to LSn, as shown in FIG. 10, are supplied with the high voltage of the output signals S1 to Sn from the shift register 140 in the aging period APD, then the entire level shifters LS1 to LSn supply voltages opposite to each other to the odd-numbered scan lines SL1, SL3, . . . , SLn-1 and the even-numbered scan line SL2, SL4, . . . , SLn by using the second high scan voltage Vhigh2 and the low scan voltage Vlow. Or, in order to raise an aging efficiency, a voltage is set to be reversed at least one time in the odd-numbered scan lines SL1, SL3, . . . , SLn-1 and the even-numbered scan lines SL2, SL4 . . . , SLn within the aging period APD.

For instance, when the second high scan voltage Vhigh2 is applied to the odd-numbered scan lines SL1, SL3, . . . , SLn-1 and the low scan voltage Vlow is applied to the even-numbered scan lines SL2, SL4, . . . , SLn, during the first period A1 of the aging period APD, the voltage is reversed during the second period A2 to apply the low scan voltage to the odd-numbered scan lines SL1, SL3, . . . , SLn-1 and to apply the second high scan voltage Vhigh2 to the even-numbered scan lines SL2, SL4, . . . , SLn.

Differently from this, as shown in FIG. 11, the aging period APD is divided into first to kth periods A1 to Ak, when the dummy stages DST1 to DSTk of the shift register 140 sequentially output a low voltage, i.e., an enable voltage. The opposite voltages Vhigh2 and Vlow applied to the odd-numbered scan lines SL1, SL3, . . . , SLn-1; SLodd and the even-numbered scan lines SL2, SL4, . . . , SLn; SLeven are set to be reversed for each boundary spot of the first to the kth periods A1 to Ak.

Or, as shown in FIG. 12, the opposite voltages Vhigh2 and Vlow applied to the odd-numbered scan lines SL1, SL3, . . . , SLn-1; SLodd and the even-numbered scan lines SL2, SL4, . . . , SLn; SLeven are set to be reversed one more time in the first to the kth periods A1 to Ak. In other words, the reverse period of the aging voltage applied to the odd-numbered scan line SLodd and the even-numbered scan line SLeven is set to be equal to each division period Ai of the aging period APD.

To this end, as shown in FIG. 9, the first and the second high scan voltages Vhigh1 and Vhigh2 together with the low scan voltage Vlow are respectively generated in power source and then may be inputted to the level shifter part 142 via power lines different from each other. Differently from this, the second high scan voltage Vhigh2 and the low scan voltage Vlow are respectively generated in the power source and then may be inputted to the level shifter part 142. In a case of the aging period, the level shifter part 142 uses the second high scan voltage Vhigh2 as it is, whereas, in a case of the scan period SPD, the level shifter 142 voltage-drops the second high scan voltage Vhigh2 to the first high scan voltage Vhigh1 with an aid of a resistance, and then uses it.

Figure 13:
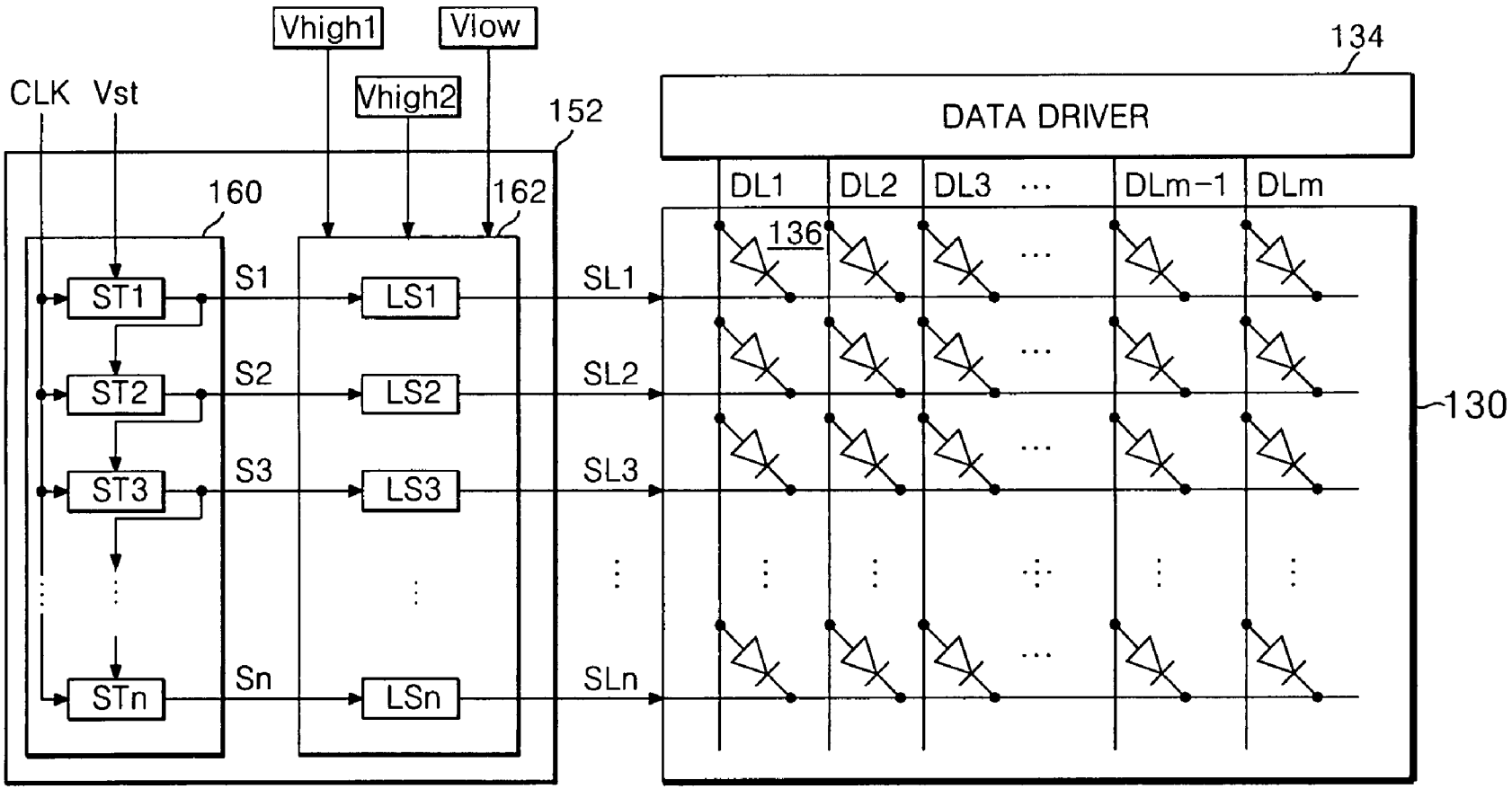
FIG. 13 is a block diagram showing an apparatus of driving an organic EL display panel according to a fourth embodiment of the present invention.
Figure 14:
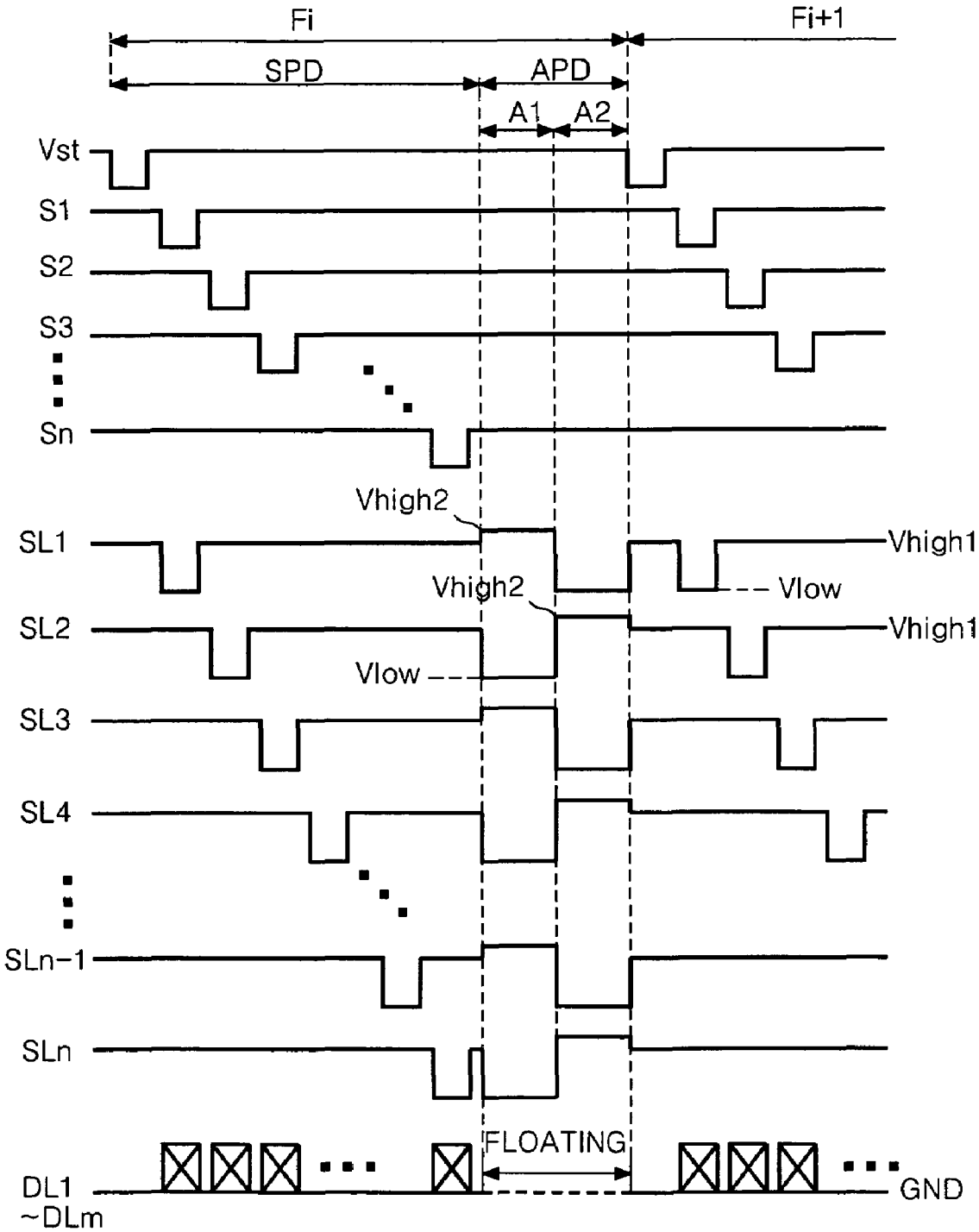
FIG. 14 is a driving waveform of the apparatus of driving the organic EL display panel shown in FIG. 13.

FIG. 13 is a block diagram showing an apparatus of driving an organic EL display panel according to a fourth embodiment of the present invention, and FIG. 14 is a driving waveform of the apparatus of driving the organic EL display panel shown in FIG. 13.

The apparatus of driving the organic EL display panel shown in FIG. 13 has composition elements identical to those of the apparatus of driving the organic EL display panel shown in FIG. 9 except that a shift register 160 of a scan driver 152 has only n number of stages ST1 to STn without a dummy stage DST. Therefore, a description on the identical composition elements will be omitted.

The scan driver 152 includes: a shift register 160, which outputs a n number of output signals Si to Sn as sequentially shifting a start pulse Vst inputted by a frame Fi unit; and a level shifter part 162 to level-shift each of output signals S1 to Sn of the shift register 160 to supply it to each of scan lines SL1 to SLn.

The n number of stages ST1 to STn included in the shift register 160 sequentially shift the start pulse Vst in accordance with a clock signal CLK to output the first to the nth output signals S1 to Sn to the level shift part 162 as shown in FIG. 14. The output signals S1 to Sn are respectively supplied to an input line of a start pulse of a next stage. Accordingly, as shown in FIG. 14, the first to the nth stages ST1 to STn sequentially output the output signals S1 to Sn of a low voltage. To secure an aging period APD next a scan period SPD, a point of supply time of the start pulse Vst in a next frame Fi+1 is delayed. During the aging period APD, the entire first to nth stages ST1 to STn output the output signals S1 to Sn of a high voltage.

If a n number of level shifters LS1 to LSn included in the level shifter part 162, as shown in FIG. 14, are supplied with the low voltage of the output signals S1 to Sn from the shift register 160 in the scan period SPD, then the level shifters LS1 to LSn select a low scan voltage Vlow, whereas, if the level shifters LS1 to LSn are supplied with the high voltage of the output signals S1 to Sn from the shift register 160 in the scan period SPD, then the level shifters LS1 to LSn select a first high scan voltage Vhigh1. Accordingly, the level shifters LS1 to LSn supply the selected voltages to each of the scan lines SL1 to SLn. Further, if the level shifters LS1 to LS, as shown in FIG. 14, are supplied with the high voltage of the output signals S1 to Sn from the shift register 160 in the aging period APD, then the entire level shifters LS1 to LSn supply voltages opposite to each other to the odd-numbered scan lines SL1, SL3, . . . , SLn-1 and the even-numbered scan line SL2, SL4, . . . , SLn by using the second high scan voltage Vhigh2 and the low scan voltage Vlow. Or, in order to raise an aging efficiency, the voltage is set to be reversed at least one time in the odd-numbered scan lines SL1, SL3, . . . , SLn-1 and the even-numbered scan lines SL2, SL4 . . . , SLn within the aging period APD.

For instance, when the second high scan voltage Vhigh2 is applied to the odd-numbered scan lines SL1, SL3, . . . , SLn-1 and the low scan voltage Vlow is applied to the even-numbered scan lines SL2, SL4, . . . , SLn, during the first period A1 of the aging period APD, as shown in FIG. 14, the voltage is reversed during the second period A2 to apply the low scan voltage Vlow to the odd-numbered scan lines SL1, SL3, . . . , SLn-1 and to apply the second high scan voltage Vhigh2 to the even-numbered scan lines SL2, SL4, . . . , SLn.

Accordingly, in the aging period APD, as the data lines are floated, a voltage difference is generated by opposite voltages between adjacent scan lines. As a result, a self-aging is performed in the entire EL cells 136. Thus, it is possible to extend a life-span of the EL panel and to prevent badness such as line.

Figure 15:
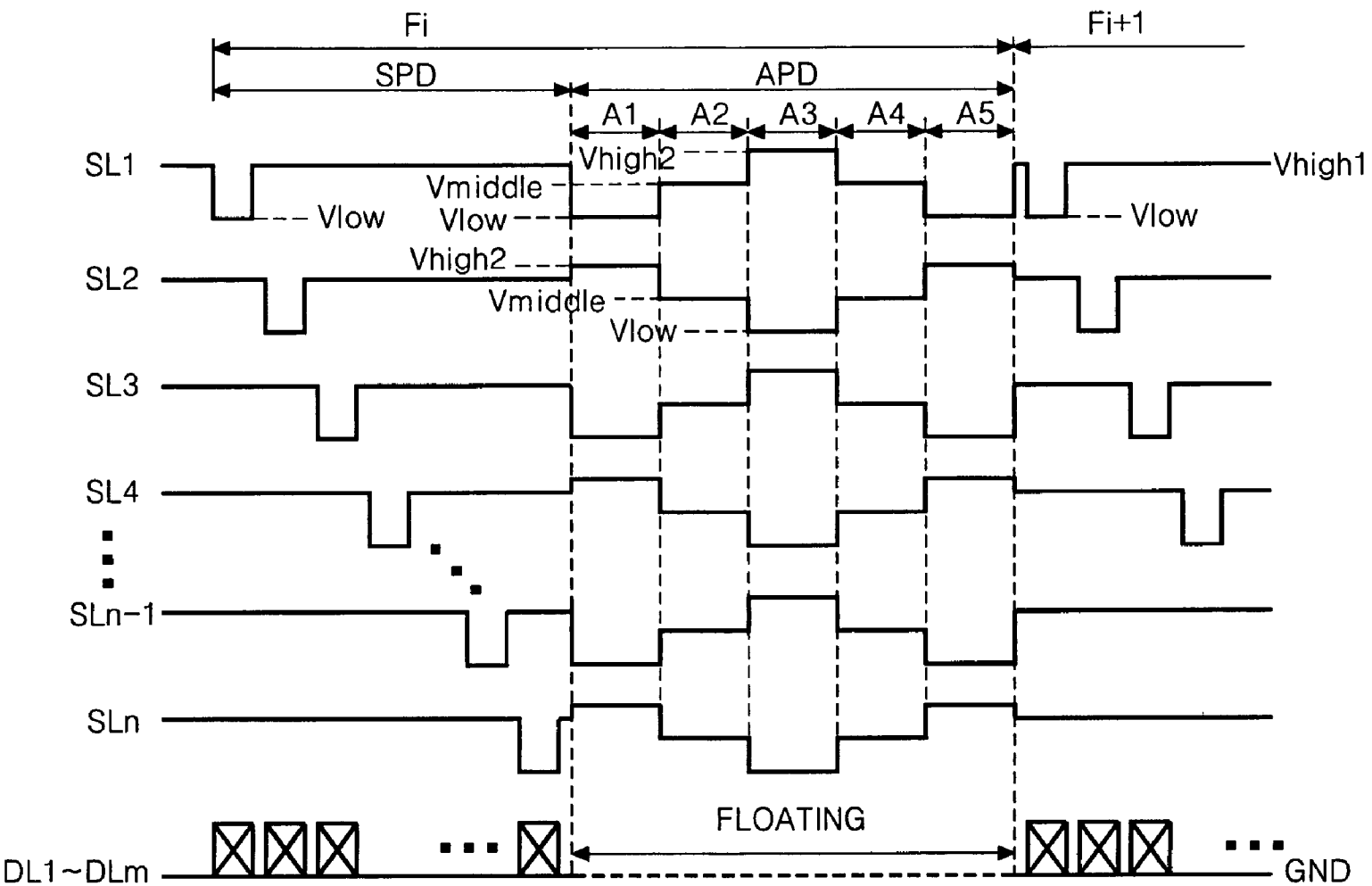
FIG. 15 is a driving waveform diagram for describing a method of driving the organic EL display panel according to the present invention.

FIG. 15 shows a driving waveform of a scan line and a data line for describing a method of driving the organic EL display panel according to the present invention.

The method of driving the organic EL display panel according to the embodiment of the present invention includes an aging period APD when an aging is performed in the EL panel upon driving. For instance, as shown in FIG. 15, a frame Fi includes a scan period SPD for line-sequentially emitting EL cells and an aging period APD for self-aging of the EL cells by a voltage difference of adjacent two scan lines. To this end, a period of the frame Fi becomes increased to secure the aging period APD separately from the scan period SPD.

In the frame Fi, a negative scan pulse, i.e., a low scan voltage Vlow, is sequentially supplied to the n number of scan lines SL1 to SLn during the scan period SPD, and a first high scan voltage Vhigh1 is supplied during the rest period. Further, a positive data signal, e.x., a current, is supplied to a m number of data lined DL1 to DLm for each period when the low scan voltage Vlow is supplied. Accordingly, the EL cells, to which a forward voltage is applied by the low scan voltage Vlow and the positive data signal, emit to generate light corresponding to the data signal. On the other hand, EL cells, to which a reverse voltage is applied by the first high scan voltage Vhigh1, do not emit light.

In the aging period APD next the scan period SPD, as the entire data lines DL1 to DLm are floated, each of the scan lines SL1 to SLn has a voltage difference with an adjacent scan line. Accordingly, an optional voltage is applied to the EL cells in accordance with a state of the EL cells to make a self-aging of the EL cells. Especially, an aging voltage, which changes into a multilevel to have a voltage difference between the odd-numbered scan lines SL1, SL3, . . . , SLn-1 and the even-numbered scan lines SL2, SL4, . . . , SLn, is supplied to raise a self-aging efficiency. As a result, the EL cells become stabilized more and more.

For instance, as shown in FIG. 15, from a first step to a fifth step A1 to A5 in the aging period APD, an aging voltage, which is changed in a sequence of a low scan voltage Vlow, a middle voltage Vmiddle, a second high scan voltage Vhigh2, a middle voltage Vmiddle, and a low scan voltage Vlow, is supplied to the odd-numbed scan lines SL1, SL3, . . . , SLn-1. At this moment, an aging voltage, which is changed in a sequence of the second high scan voltage Vhigh2, the middle voltage Vmiddle, the low scan voltage Vlow, the middle voltage Vmiddle, and the second high scan voltage Vhigh2, is supplied to the even-numbered scan lines SL2, SL4, . . . , SLn oppositely to the odd-numbered scan lines SL1, SL3, . . . , SLn-1. Herein, the second high scan voltage Vhigh2, i.e., the high aging voltage, is set to be larger than the first high scan voltage Vhigh1 applied in the scan period SPD, or to be equal to the first high scan voltage Vhigh1. For instance, the second high scan voltage Vhigh2 is set as a larger voltage as much as about 10% to 20% than the first scan high voltage Vhigh1. The data lines DL1 to DLm are floated in the aging period APD.

Accordingly, a voltage difference between adjacent scan lines, i.e. the odd-numbed scan lines SL1, SL3, . . . , SLn-1 and the even-numbed scan lines SL2, SL4, . . . , SLn, makes that a self-aging is performed in the EL cells having the floated data lines DL1 to DLm. Further, the aging period APD includes a neutralization step when voltages of the odd-numbed scan lines SL1, SL3, . . . , SLn-1 and the even-numbed scan lines SL2, SL4, . . . , SLn become the same as the middle voltage Vmiddle. By the neutralization step, a parasitic capacitor formed in the EL panel can be reduced.

Moreover, a driving waveform capable of supplying to the scan lines SL1 to SLn in the aging period APD is various as shown in FIGS. 16 to 18B.

Figure 16:
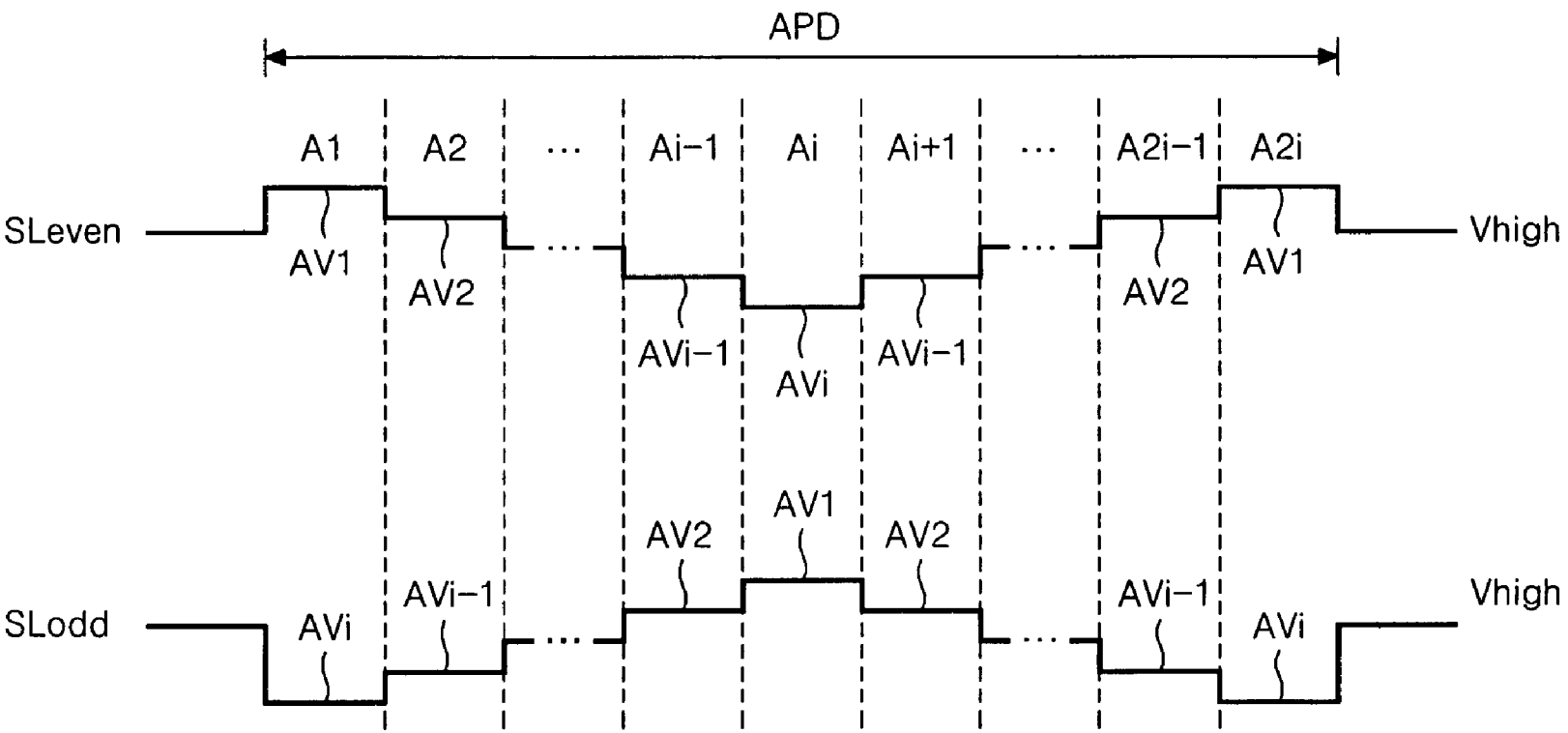
FIG. 16 is another scan driving waveform diagram in the aging period of the present invention.

Referring to FIG. 16, in the aging period APD, an aging voltage AV1 to AVi, which changes into first to (2*i*)th steps, is supplied to the odd-numbered scan lines SL1, SL3, . . . , SLn-1; SLodd, and an aging voltage AVi to AV1, which changed into the first to the (2*i*)th steps A1 to A2*i*, is supplied to the even-numbered scan lines SL2, SL4, . . . , SLn; SLeven in a direction opposite to the odd-numbered scan line SLodd.

More specifically, an aging voltage, which is decreased in a sequence of AV1, AV2, . . . , AVi-1, and AVi from the first to the (2*i*)th steps A1 to A2*i* of the aging period APD and then is again increased in a sequence of AVi-1, . . . , AV2, and AV1, is supplied to the odd-numbered scan line SLodd. On the other hand, an aging voltage, which is increased in a sequence of AVi, AVi-1, . . . , AV2, and AV1 and then is decreased in a sequence of AV2, . . . , AVi-1, and AVi, is supplied to the even-numbered scan line SLeven. Accordingly, a voltage difference between the odd-numbed and the even-numbed scan lines SLodd and SLeven is differentiated for each of the first to the (2*i*)th steps A1 to A2*i*. In other words, as shown in FIG. 16, the voltage difference between the odd-numbered and the even-numbered scan lines SLodd and SLeven is sequentially decreased in the first to the ith steps A1 to Ai, and is sequentially increased in the (i+1)th to the (2*i*)th steps Ai+1 to A2*i*, so that a self-aging is effectively performed in the EL cells. Further, oppositely to FIG. 16, when a multilevel aging voltage A1 to Ai is supplied to the odd-numbered and the even-numbered scan lines SLodd and SLeven, the voltage difference between the odd-numbered and the even-numbered scan lines SLodd and SLeven is sequentially increased and than is decreased in opposition to the above case. Thus, a self-aging is effectively performed in the EL cells.

And, in the aging period APD, the odd-numbered and the even-numbered scan lines SLodd and SLeven become the same with a middle voltage in the multilevel aging voltage AV1 to AVi. Accordingly, the APD period includes at least one time neutralization step to reduce a parasitic capacitor in the EL panel.

Also, the multilevel aging voltage AV1 to AVi is supplied to any one of the odd-numbered and the even-numbered scan lines SLodd and SLeven as shown in FIGS. 17A to 18B, and the reset scan lines is possible to be fixed with a lowest aging voltage AV1, i.e., a low scan voltage Vlow.

Figure 17A:
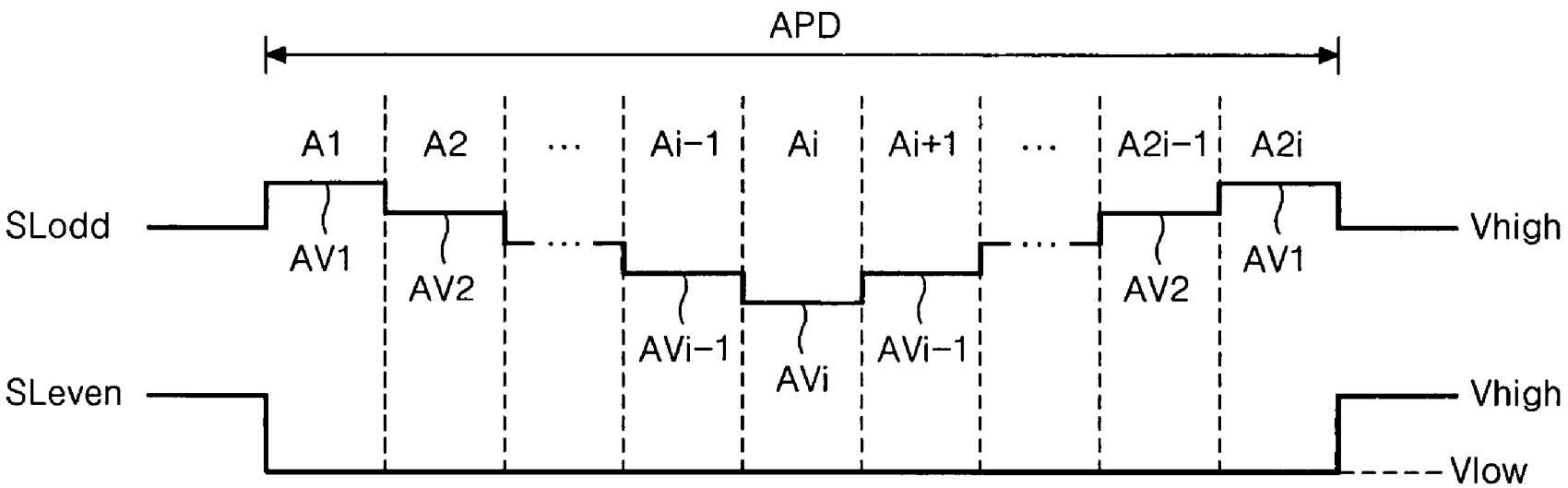
FIGS. 17A and 17B are another scan driving waveform diagrams in the aging period of the present invention.
Figure 17B:
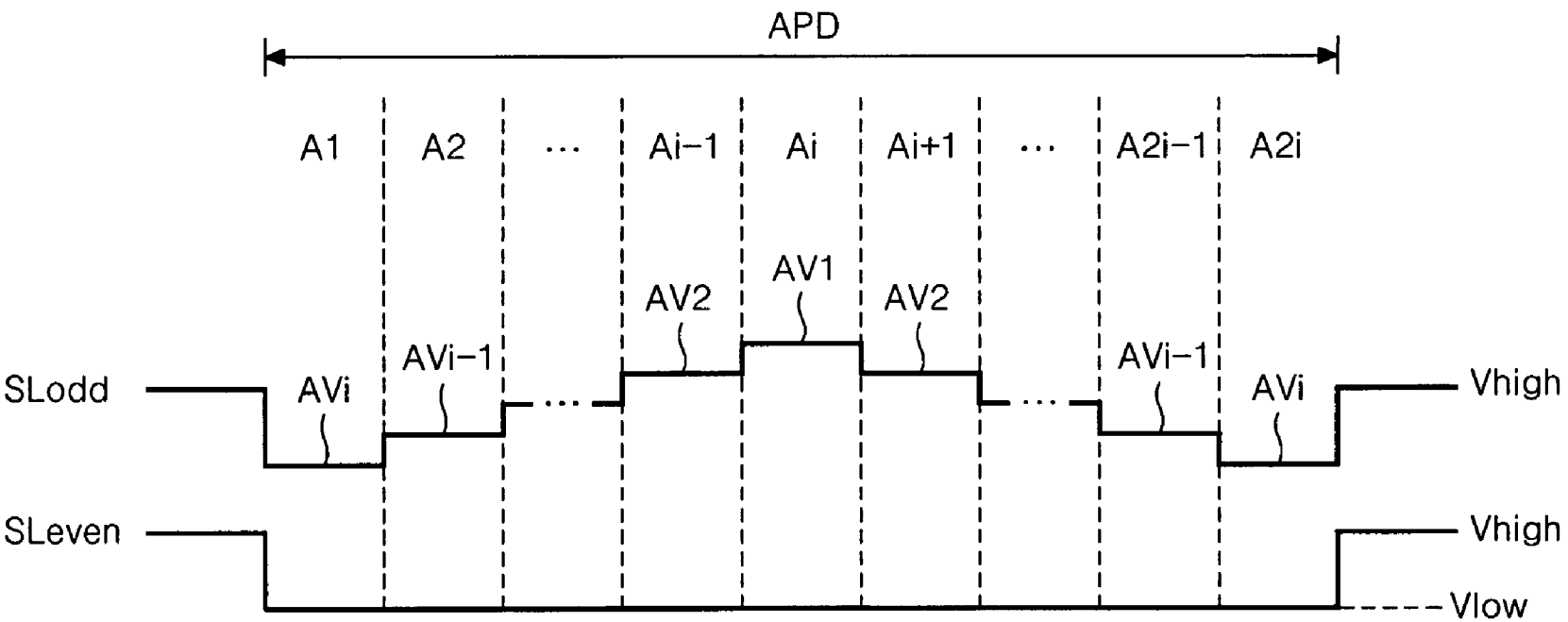

More specifically, the even-numbered scan line SLeven is fixed with the low scan voltage Vlow, and the odd-numbered scan line SLodd is supplied with an aging voltage, which changes in a sequence of AV1, AV2, . . . , AVi-1, AVi, AVi-1, . . . AV2, and AV1 as shown in FIG. 17A, from the first to the (2*i*)th steps A1 to A2*i*. Or, the odd-numbered scan line SLodd is supplied with an aging voltage, which changes in a sequence of AVi, AVi-1, . . . , AV2, AV1, AV2, . . . , AVi-1, and AVi, as shown in FIG. 17B, from the first to the (2*i*)th steps A1 to A2*i*.

Figure 18A:
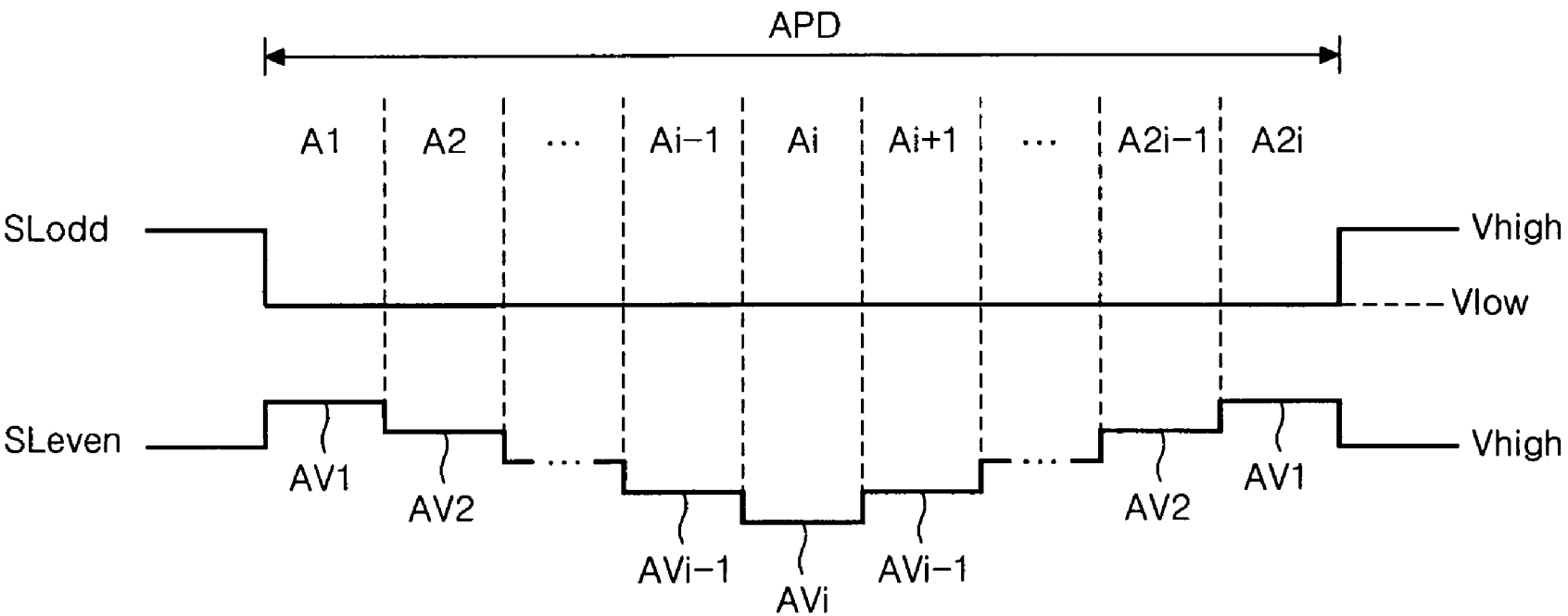
FIGS. 18A and 18B are still another scan driving waveform diagrams in the aging period of the present invention.
Figure 18B:
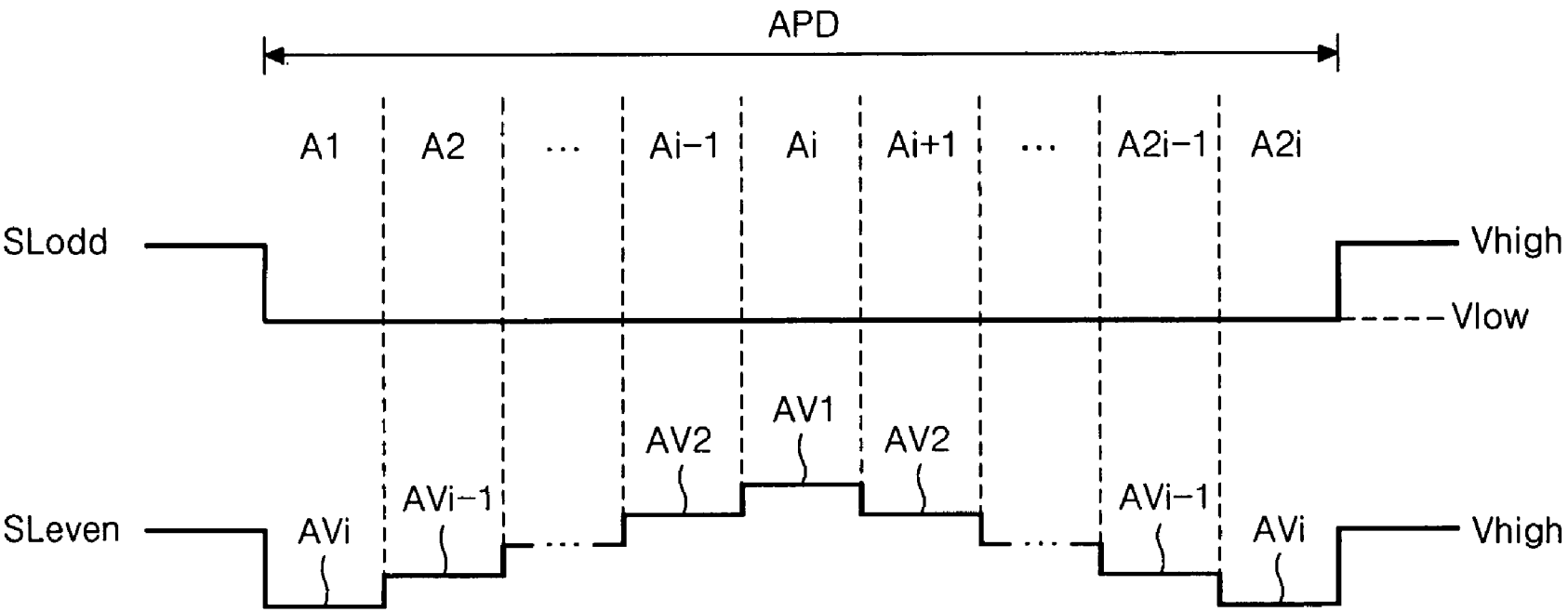

On the other hand, the odd-numbered scan line SLodd is fixed with the low scan voltage Vlow, and the even-numbered scan line SLeven is supplied with an aging voltage, which changes in a sequence of AV1, AV2, . . . , AVi-1, AVi, AVi-1, . . . AV2, and AV1 as shown in FIG. 18A, from the first to the (2*i*)th steps A1 to A2*i*. Or, the even-numbered scan line SLeven is supplied with an aging voltage, which changes in a sequence of AVi, AVi-1, . . . , AV2, AV1, AV2, . . . , AVi-1, and AVi, as shown in FIG. 18B, from the first to the (2*i*)th steps A1 to A2*i*.

Accordingly, a voltage difference between the odd-numbed and the even-numbed scan lines SLodd and SLeven is differentiated for each of the first to the (2*i*)th steps A1 to A2*i*. In other words, as shown in FIGS. 17A and 18B, a voltage difference between the odd-numbered and the even-numbered scan lines SLodd and SLeven is sequentially decreased and then increased in the first to the (2*i*)th steps A1 to A2*i*, so that a self-aging is effectively performed in the EL cells. On the other hand, as shown in FIGS. 17B and 18A, the voltage difference between the odd-numbered and the even-numbered scan lines SLodd and SLeven is sequentially increased and than is decreased in opposition to the above case. Thus, a self-aging is effectively performed in the EL cells.

And, in the aging period APD, the odd-numbered and the even-numbered scan lines SLodd and SLeven become the same with the lowest aging voltage AVi of the multilevel aging voltage AV1 to AVi, i.e., the low scan voltage Vlow. Accordingly, the APD period includes at least one time neutralization step to reduce a parasitic capacitor in the EL panel.

In addition, in the aging period APD of the present invention, it is possible to repeat the above-described first to (2*i*)th steps.

As described above, the method of driving the organic EL display device according to the embodiment of the present invention secure the aging period APD when a self-aging is performed in a multilevel in the entire EL cells during one frame Fi to enable to do self-aging of the EL panel upon driving. Accordingly, it is possible to extend a life-span of the EL panel and to prevent badness such as line defect caused by a stress.

Figure 19:
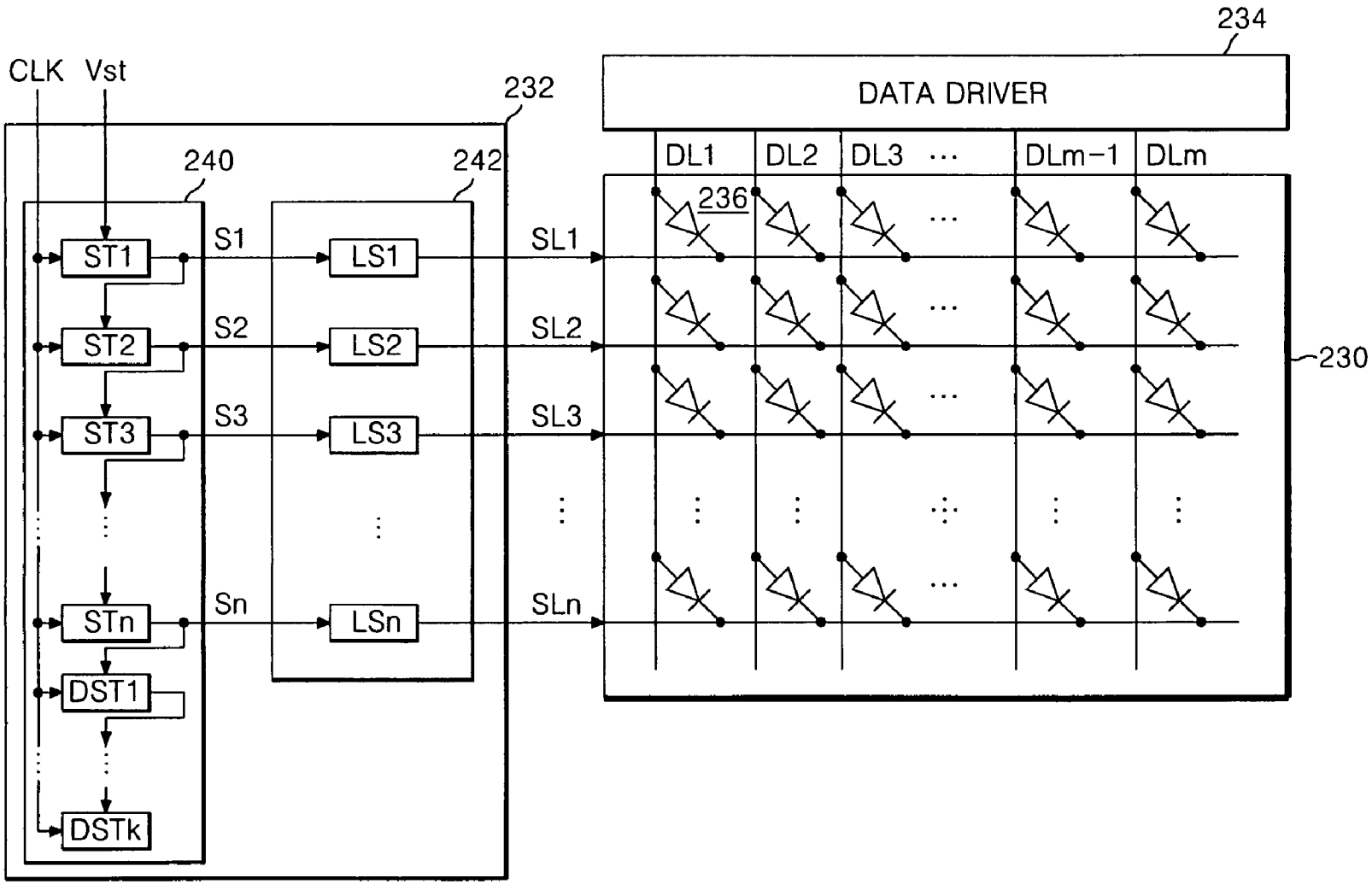
FIG. 19 is a block diagram showing an apparatus of driving an organic EL display panel according to a fifth embodiment of the present invention.
Figure 20:
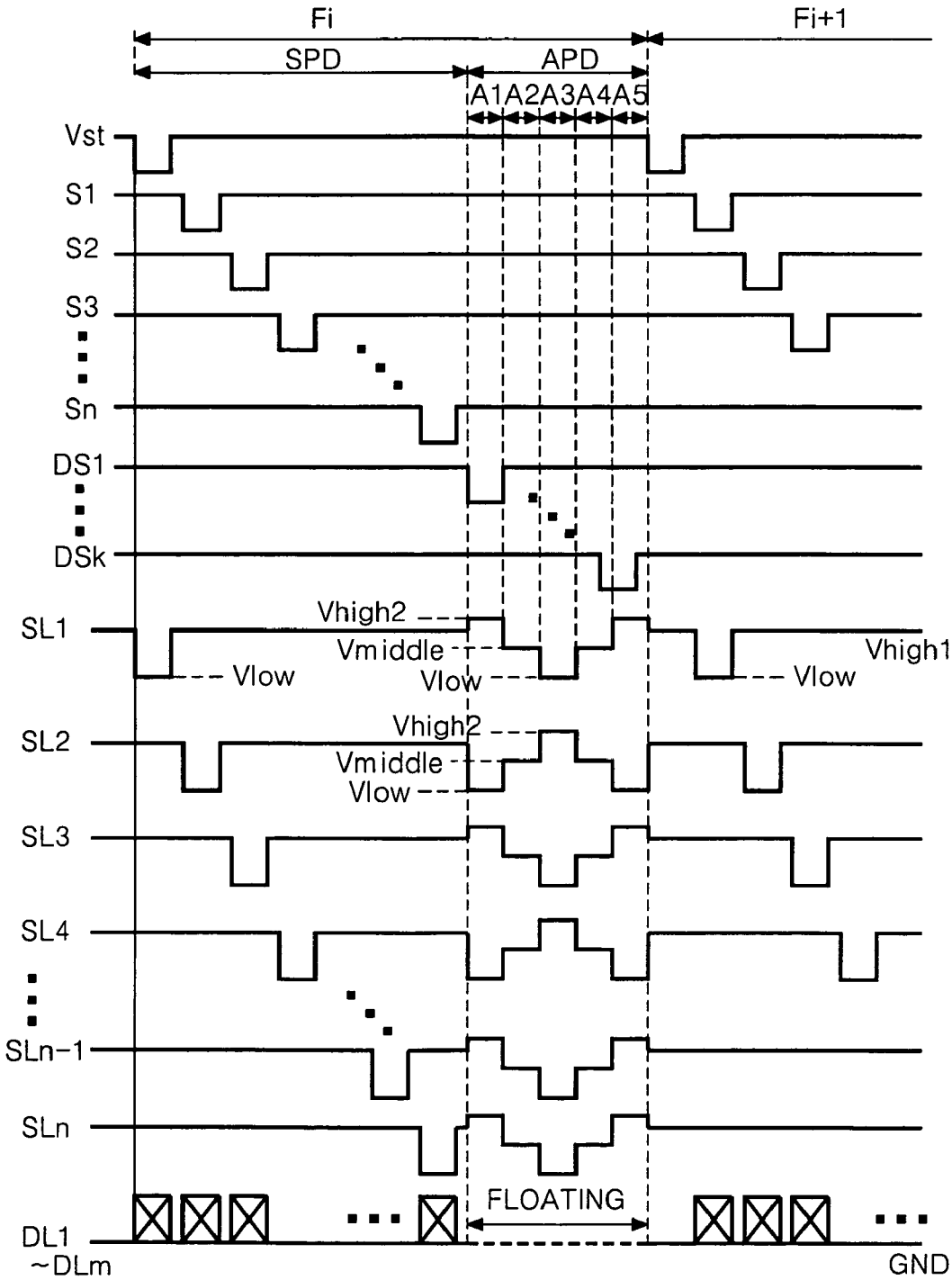
FIG. 20 is a driving waveform of the apparatus of driving the organic EL display panel shown in FIG. 19.

FIG. 19 is a block diagram showing an apparatus of driving an organic EL display panel according to a fifth embodiment of the present invention, and FIG. 20 is a driving waveform of the apparatus of driving the organic EL display panel shown in FIG. 19.

The apparatus of driving the EL display panel shown in FIG. 19 includes: an EL panel 230 having an EL cell 236 formed at a cross of both scan lines SL1 to SLn and data lines DL1 to DLm; a scan driver 232 for driving the scan lines SL1 to SLn; and a data driver 234 for driving the data lines DL1 to DLm.

Each of the EL cells 236 formed in the EL panel 230 is represented as a diode, which is connected in a forward direction between the data line DL and the scan line SL. Herein, the data line DL is equivalently an anode and the scan line SL is equivalently a cathode. If a low scan voltage Vlow is supplied to the scan line SL and a positive data signal(current) is supplied to the data line DL to apply a forward voltage to each EL cell 236 in a scan period SPD, then each EL cell 236 emits light to generate light corresponding to the data signal. On the other hand, if a first high scan voltage Vhigh1 is supplied to the scan line SL to thereby apply a reverse voltage to each EL cell 236, then each EL cell 236 does not emit light. Further, If the data lines DL1 to DLn are floated, and a difference of voltage, changed to a multilevel is generated in the odd-numbered scan lines SL1, SL3, . . . , SLn-1 and the even-numbered scan lines SL2, SL4, . . . , SLn, in the aging period APD, then the each of the EL cells 236 does not emit light and a self-aging is performed in the EL cells 236.

The data driver 234 supplies a data signal to the m number of data lines DL1 to DLm for each period when the scan lines SL1 to SLn are enabled during the scan period SPD, and the data driver 234 floats the data lines DL1 to DLm during the aging period APD.

The scan driver 232, as shown in FIG. 20, sequentially supplies a low scan voltage Vlow to the n number of scan lines SL1 to SLn in a scan period SPD of a frame Fi, and supplies a first high scan voltage Vhigh1 in the rest period. Further, the scan driver 232 supplies aging voltages, which is changed to a multilevel to make the odd-numbered scan lines SL1, SL3, . . . , SLn-1 and the even-numbered scan lines SL2, SL4, . . . , SLn have a voltage difference of a multilevel in the aging period APD of one frame Fi.

For this, the scan driver 232 includes: a shift register 240, which outputs a n number of output signals S1 to Sn as sequentially shifting a start pulse Vst inputted by a frame Fi unit, and makes to secure an aging period APD; and a level shifter part 242 to level-shift each of output signals S1 to Sn of the shift register 240 to supply it to each of scan lines SL1 to SLn.

The shift register 240 includes: a n number of stages ST1 to STn for outputting the n number of output signals S1 to Sn as shifting the start pulse; and a k number of dummy stages DST1 to DSTk to make to secure an aging period APD as shifting the output signal Sn of the nth stage STn.

The n number of stages ST1 to STn and the k number of dummy stages DST1 to DSTk are connected, in series, to an input line of the start pulse Vst, and are commonly connected to an input line of a clock signal CLK. The first to the nth stage ST1 to STn sequentially shift the start pulse Vst in accordance with the clock signal CLK to output the first to the nth output signal S1 to Sn to the level shifter part 242 as shown in FIG. 20. In this case, each of the output signals S1 to Sn of the n number of stages ST1 to STn is supplies to an input line of a start pulse of a next stage. The k number of dummy stages DST1 to DSTk sequentially shift the output signal Sn of the nth stage STn in accordance with the clock signal CLK. Each of the output signals DS1 to DSk of the k number of dummy stages DST1 to DSTk is not outputted to the level shifter part 242 and is supplies to an input line of a start pulse of a next dummy stage. Accordingly, each frame Fi, as shown in FIG. 20, becomes secure a dummy period, when the dummy stages DST1 to DSTk sequentially output the output signals DS1 to DSk of a low voltage, as an aging period, separately from the scan period SPD, when the first to the nth stage ST1 to STn output the output signals S1 to Sn of a low voltage, i.e., an enable voltage. During the aging period, the entire first to the nth stage ST1 to STn output the output signals S1 to Sn of a high voltage.

The level shifter part 242 includes a n number of level shifters LS1 to LSn, which are respectively connected between the n number of stages ST1 to STn and the n number of scan lines SL1 to SLn. If the level shifters LS1 to LSn, as shown in FIG. 20, are supplied with the low voltage, i.e., an enable voltage of the output signals S1 to Sn from the shift register 240, in the scan period SPD, then the level shifters LS1 to LSn select a low scan voltage Vlow, whereas, if the level shifters LS1 to LSn are supplied with the high voltage, i.e., a disable voltage, of the output signals S1 to Sn from the shift register 240 in the scan period SPD, then the level shifters LS1 to LSn select a first high scan voltage Vhigh1. Accordingly, the level shifters LS1 to LSn supply the selected voltages to each of the scan lines SL1 to SLn. Further, if the level shifters LS1 to LSn, as shown in FIG. 20, are supplied with the high voltage of the output signals S1 to Sn from the shift register 240 in the aging period APD, then the entire level shifters LS1 to LSn stepwise supply an aging voltage, which is changed in an opposite direction to the odd-numbered scan lines SL1, SL3, . . . , SLn-1 and the even-numbered scan lines SL2, SL4, . . . , SLn.

For instance, as shown in FIGS. 15 and 20, an aging voltage is changed in a sequence of Vhigh2, Vmiddle, Vlow, Vmiddle, and Vhigh2 in the odd-numbered scan lines SL1, SL3, . . . , SLn-1 from first to fifth steps A1 to A5, and an aging voltage is changed in a sequence of Vlow, Vmiddle, Vhigh2, Vmiddle, and Vlow in the even-numbered scan lines SL2, SL4, . . . , SLn from first to fifth steps A1 to A5. Or, as shown in FIGS. 16 to 18B, an aging voltage, which is changed from the first to the (2*i*)th steps, is supplied.

To this end, the level shifter part 242 entirely inputs the multilevel aging voltage AV1 to AVi to use them, or inputs only the highest aging voltage AV1 and the lowest aging voltage AVi and then divides the highest aging voltage AV1 by a divided-voltage resistance to use it.

Further, in the multi-step A1 to Ai dividing the aging period APD, the aging period APD, as shown in FIG. 20, is classified as a period when each of the dummy stages DST1 to DSTk of the shift register 240 outputs the low voltage, i.e., an enable voltage.

Figure 21:
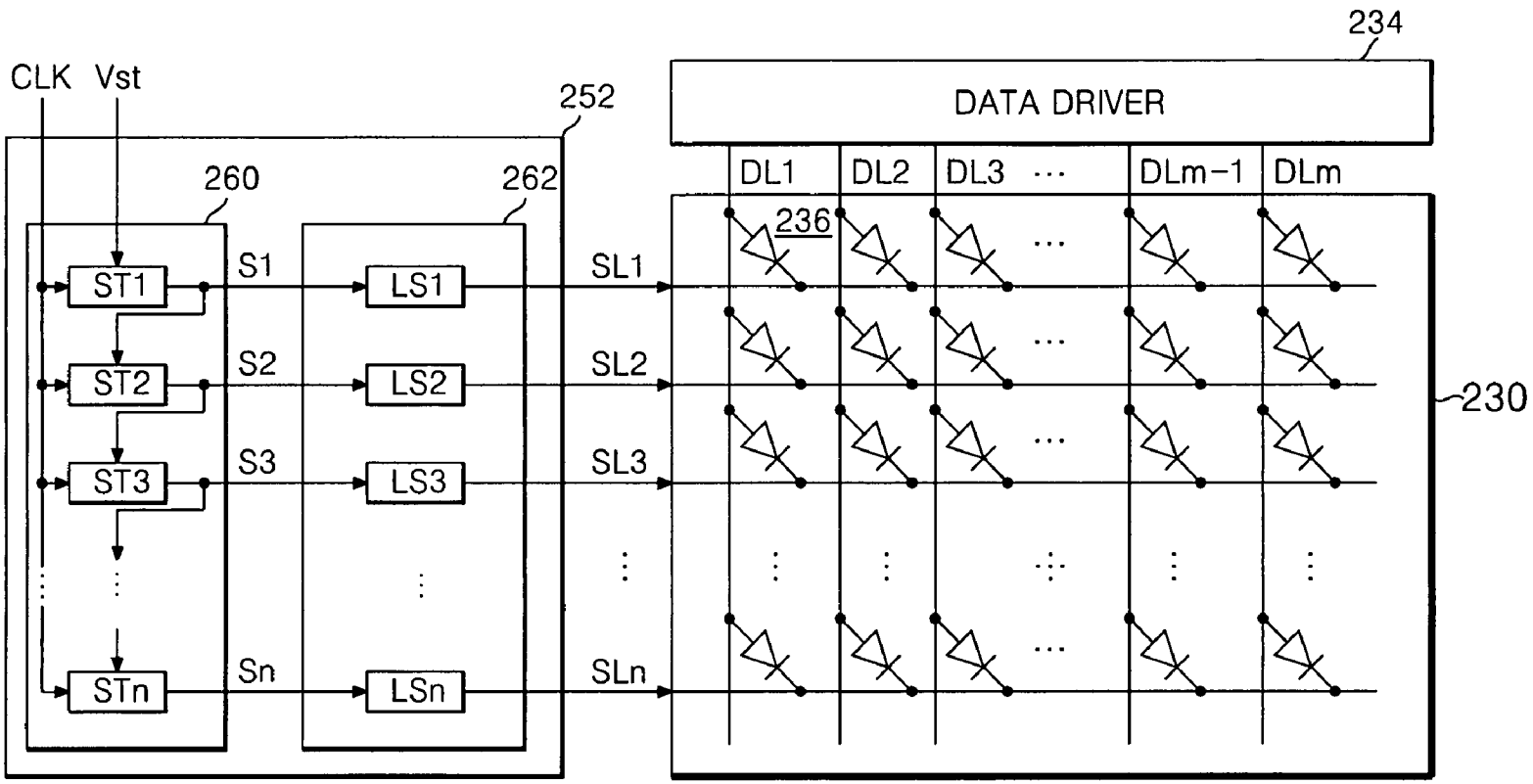
FIG. 21 is a block diagram showing an apparatus of driving an organic EL display panel according to a sixth embodiment of the present invention.
Figure 22:
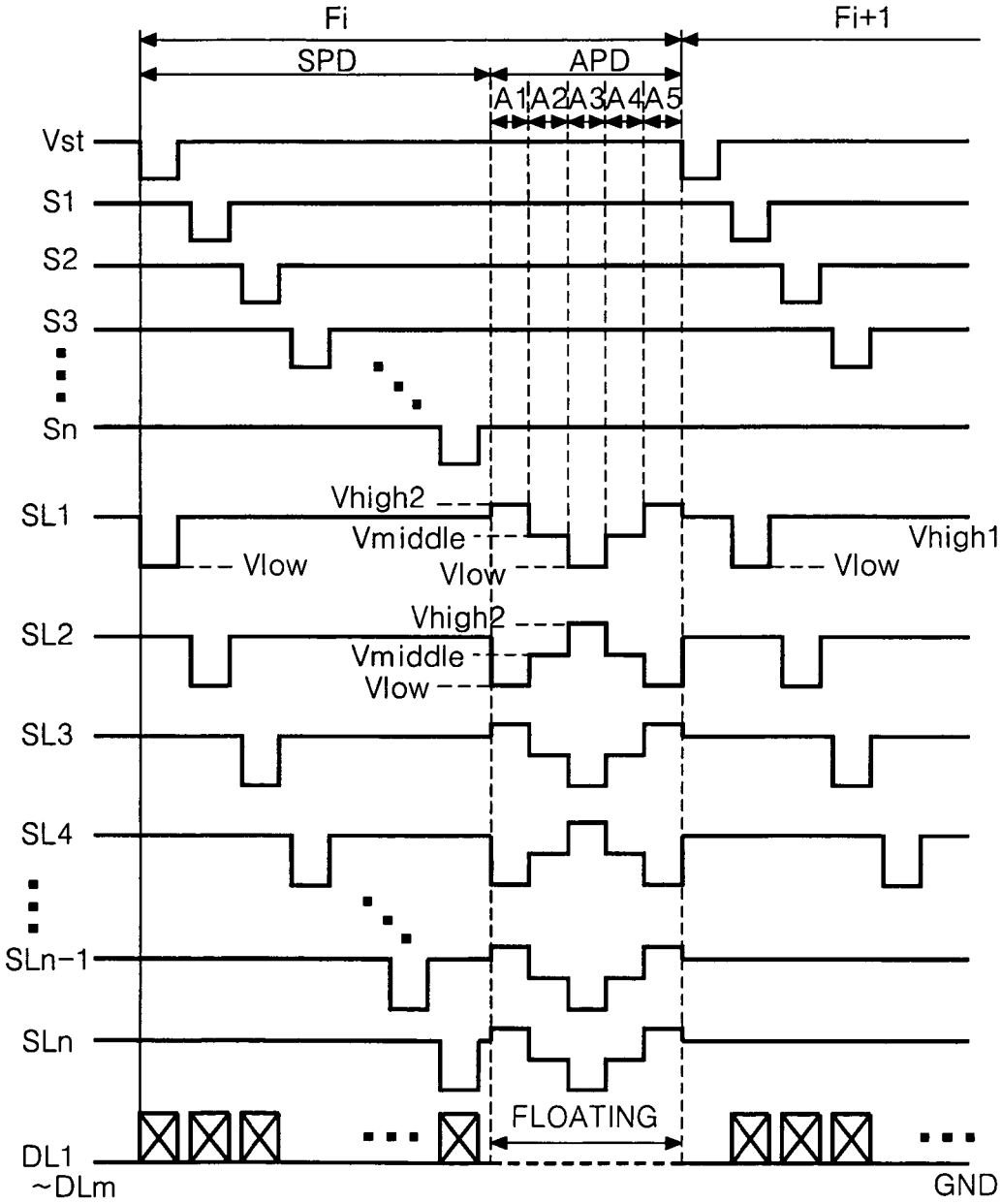
FIG. 22 is a driving waveform of the apparatus of driving the organic EL display panel shown in FIG. 21.

FIG. 21 is a block diagram showing an apparatus of driving an organic EL display panel according to a sixth embodiment of the present invention, and FIG. 22 is a driving waveform of the apparatus of driving the organic EL display panel shown in FIG. 21.

The apparatus of driving the organic EL display panel shown in FIG. 21 has composition elements identical to those of the apparatus of driving the organic EL display panel shown in FIG. 19 except that a shift register 260 of a scan driver 252 has only n number of stages ST1 to STn without a dummy stage DST. Therefore, a description on the identical composition elements will be omitted.

The scan driver 252 includes: a shift register 260, which outputs a n number of output signals S1 to Sn as sequentially shifting a start pulse Vst inputted by a frame Fi unit; and a level shifter part 262 to level-shift each of output signals S1 to Sn of the shift register 260 to supply it to each of scan lines SL1 to SLn.

The n number of stages ST1 to STn included in the shift register 260 sequentially shift the start pulse Vst in accordance with a clock signal CLK to output the first to the nth output signals S1 to Sn to the level shift part 262 as shown in FIG. 22. The output signals S1 to Sn are respectively supplied to an input line of a start pulse of a next stage. Accordingly, as shown in FIG. 22, the first to the nth stages ST1 to STn sequentially output the output signals S1 to Sn of a low voltage. To secure an aging period APD next a scan period SPD, a point of supply time of the start pulse Vst in a next frame Fi+1 is delayed. During the aging period APD, the entire first to nth stages ST1 to STn output the output signals S1 to Sn of a high voltage.

If a n number of level shifters LS1 to LSn included in the level shifter part 262, as shown in FIG. 22, are supplied with the low voltage of the output signals S1 to Sn from the shift register 260 in the scan period SPD, then the level shifters LS1 to LSn select a low scan voltage Vlow, whereas, if the level shifters LS1 to LSn are supplied with the high voltage of the output signals S1 to Sn from the shift register 260 in the scan period SPD, then the level shifters LS1 to LSn select a first high scan voltage Vhigh1. Accordingly, the level shifters LS1 to LSn supply the selected voltages to each of the scan lines SL1 to SLn. Further, if the level shifters LS1 to LSn, as shown in FIG. 22, are supplied with the high voltage of the output signals S1 to Sn from the shift register 260 in the aging period APD, then the entire level shifters LS1 to LSn stepwise supply an aging voltage, which is changed in an opposite direction to the odd-numbered scan lines SL1, SL3, . . . , SLn-1 and the even-numbered scan lines SL2, SL4, . . . , SLn.

For instance, as shown in FIGS. 16 and 22, an aging voltage is changed in a sequence of Vhigh2, Vmiddle, Vlow, Vmiddle, and Vhigh2 in the odd-numbered scan lines SL1, SL3, . . . , SLn-1 from first to fifth steps A1 to A5, and an aging voltage is changed in a sequence of Vlow, Vmiddle, Vhigh2, Vmiddle, and Vlow in the even-numbered scan lines SL2, SL4, . . . , SLn from first to fifth steps A1 to A5. Or, as shown in FIGS. 16 to 18B, an aging voltage AV1 to AVi, which is changed from the first to the (2*i*)th steps, is supplied.

Accordingly, in the aging period APD, as the data lines are floated, a voltage difference of the multilevel is generated between adjacent scan lines. As a result, a self-aging is performed in the entire EL cells 236. Thus, it is possible to extend a life-span of the EL panel 230 and to prevent badness such as line defect.

Figure 23:
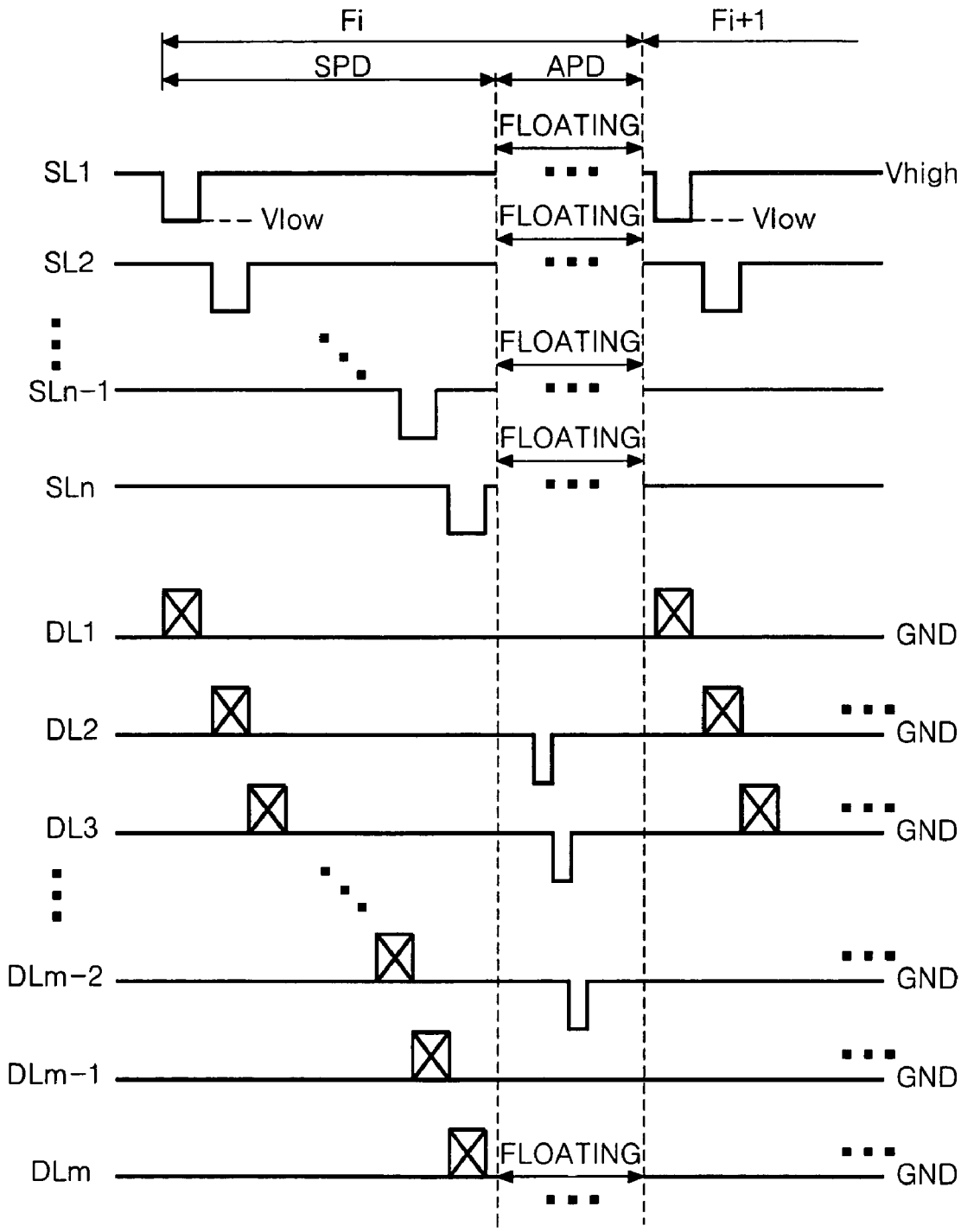
FIG. 23 is a driving waveform diagram for describing a method of driving the organic EL display panel according to a seventh embodiment of the present invention.

FIG. 23 is a driving waveform diagram of a scan line and a data line for describing a method of driving the organic EL display panel according to a seventh embodiment of the present invention.

The method of driving the organic EL display panel according to the seventh embodiment of the present invention includes an aging period APD when an aging is performed in the EL panel upon driving. For instance, as shown in FIG. 23, a frame Fi includes a scan period SPD for line-sequentially emitting EL cells and an aging period APD to make a self-aging is performed in the EL cells by a voltage difference of adjacent two data lines. To this end, a period of the frame Fi becomes increased to secure the aging period APD separately from the scan period SPD.

In one frame Fi, a negative scan pulse, i.e., a low scan voltage Vlow, is sequentially supplied to the n number of scan lines SL1 to SLn during the scan period SPD, and a high scan voltage Vhigh is supplied during the rest period. Further, a positive data signal, e.x., a current, is supplied to a m number of data lined DL1 to DLm for each period when the low scan voltage Vlow is supplied. Accordingly, the EL cells, to which a forward voltage is applied by the low scan voltage Vlow and the positive data signal, emit to generate light corresponding to the data signal. On the other hand, EL cells, to which a reverse voltage is applied by the high scan voltage Vhigh, do not emit light.

In the aging period APD next the scan period SPD, as the entire scan lines SL1 SLn are floated, each of the data lines DL1 to DLm has a voltage difference with an adjacent data line. Accordingly, an optional voltage is applied to the EL cells in accordance with a state of the EL cells to make a self-aging of the EL cells. As a result, the EL cells become more stabilized.

For instance, a signal as shown in FIG. 24 can be repeatedly applied to the data lines DL1 to DLm, which are connected to each of sub-pixels R, G and B, in the aging period APD. To specifically describe this as an example, the high voltage Vhigh is applied to the data line DL1 connected to the R sub-pixel as shown in the first state, the low voltage Vlow is applied to the data lines DL2 and DL3 connected to the G sub-pixel and the B sub-pixel, and the voltage applying of the first state is repeatedly applied to other data lines DL4 to DLm. Accordingly, each of the data lines DL1 to DLm has a voltage difference with an adjacent data line. Accordingly, an optional voltage is applied to the EL cells in accordance with a state of the EL cells to make a self-aging of the EL cells.

Further, as shown in the twelfth state, the low voltage Vlow is applied to the data line DL1 connected to the R sub-pixel, the high voltage Vhigh is applied to the data line DL2 connected to the G sub-pixel, and the data line DL3 connected to the B sub-pixel is floated. Accordingly, each of the data lines DL1 to DLm has a voltage difference with an adjacent data line. Accordingly, an optional voltage is applied to the EL cells in accordance with a state of the EL cells to make a self-aging of the EL cells.

Consequently, in the method of driving the EL display panel according to the embodiment of the present invention, the signal applied to each of the sub-pixels R, G, and B is applied by associating three states of the high voltage Vhigh, the low voltage Vlow, and the floating. Accordingly, each of the data lines DL1 to DLm has a voltage difference with an adjacent data line to make a self-aging of the EL cells.

As described above, the method of driving the organic EL display device according to the embodiment of the present invention secure the aging period APD when the self-aging is performed in the entire EL cells in one frame Fi to enable to do self-aging of the EL panel upon driving. Accordingly, it is possible to extend a life-span of the EL panel and to prevent badness such as line defect caused by a stress.

Figure 25:
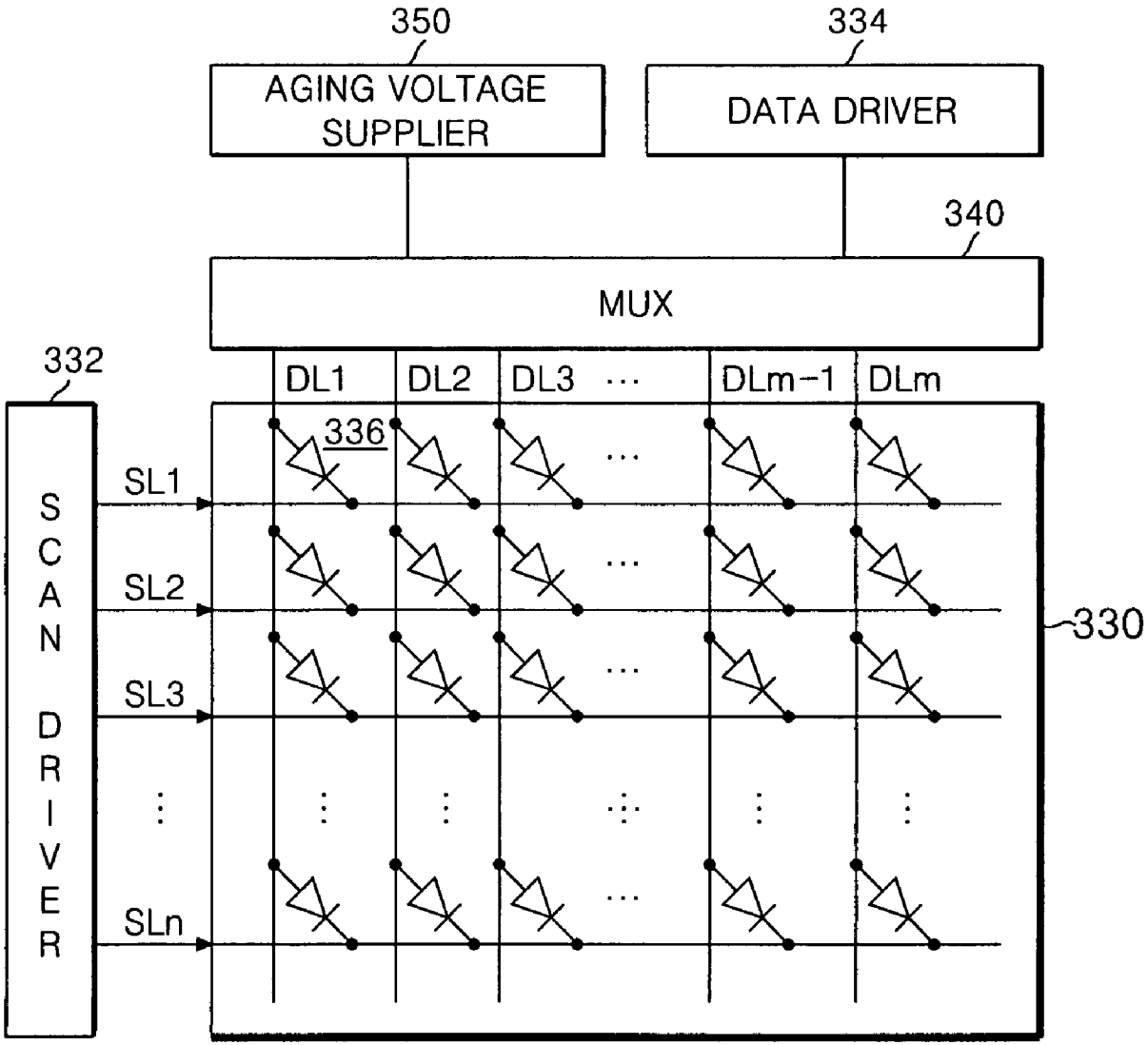
FIG. 25 is a block diagram showing an apparatus of driving an organic EL display panel according to the seventh embodiment of the present invention.

FIG. 25 is a block diagram showing an apparatus of driving an organic EL display panel according to the seventh embodiment of the present invention.

The apparatus of driving the EL display panel shown in FIG. 25 includes: an EL panel 330 having an EL cell 336 formed at a cross of both scan lines SL1 to SLn and data lines DL1 to DLm; a scan driver 332 for driving the scan lines SL1 to SLn; a data driver 334 for driving the data lines DL1 to DLm; an aging voltage supplier 350 for supplying a signal for an aging by using the data lines DL1 to DLm; and a multiplexer MUX 340 for switching the data driver 334 and the aging voltage supplier 350.

Each of the EL cells 336 formed in the EL panel 330 is represented as a diode, which is connected in a forward direction between the data line DL and the scan line SL. Herein, the data line DL is equivalently an anode and the scan line SL is equivalently a cathode. If a low scan voltage Vlow, is supplied to the scan line SL and a positive data signal(current) is supplied to the data line DL in the scan period SPD to apply a forward voltage to each EL cell 336, then each EL cell 336 emits light to generate light corresponding to the data signal. On the other hand, if a high scan voltage is supplied to the scan line SL to thereby apply a reverse voltage to each EL cell 336, then each EL cell 336 does not emit light. Further, as the scan lines SL1 to SLm are floated, a voltage is applied to each of the data lines DL1 to DLn so that each of the data lines DL1 to DLn has a voltage difference with an adjacent data line. Accordingly, the each of the EL cells 336 does not emit light and a self-aging is performed in the EL cells 336.

The scan driver 332 sequentially supplies a low scan voltage Vlow to a n number of scan lines SL1 to SLn in a scan period SPD of a frame Fi, and supplies a high scan voltage Vhigh in the rest period.

The data driver 334 supplies a data signal to a m number of data lines DL1 to DLm for each period when the scan lines are enabled in the scan period SPD.

The aging voltage supplier 350 generates an aging signal supplied to the data lines DL1 to DLm during the aging period. Herein, the aging signal can be repeatedly applied to the data lines DL1 to DLm connected to each of the sub-pixels R, G, and B by associating three states of the high voltage Vhigh, the low voltage Vlow, and the floating. Further, the aging signal can be applied without dividing the sub-pixels R, G, and B, by associating three states of the high voltage Vhigh, the low voltage Vlow, and the floating, so that each of the data lines DL1 to DLm has a voltage difference with an adjacent data line.

The MUX 340 supplies the data signal, which is supplied from the data driver 334, to each of the data lines DL1 to DLm, to thereby implement a picture during the scan period SPD, and supplies the aging signal, which is supplied from the aging voltage supplier 350, to each of the data lines DL1 to DLm, to thereby make an self-aging is performed in each EL cell during the aging period APD.

Herein, the apparatus of driving the organic EL display panel according to the embodiment of the present invention may be integrated as one chip by integrating the aging voltage supplier 350, the MUX 340 the data driver 334.

In the organic EL display panel according to the embodiment of the present invention having the above-mentioned structure, as the data lines DL1 to DLm are floated in the aging period APD, a voltage difference of the multilevel is generated between adjacent scan lines. As a result, a self-aging is performed in the entire EL cells 336. Thus, it is possible to extend a life-span of the EL panel 330 and to prevent badness such as line defect.

As described above, in the method and the apparatus of driving the organic EL display device according to the embodiment of the present invention, the aging period to make an entire EL cells to be a reverse bias state is secured separately from the scan period to thereby do an aging of the EL panel upon driving. Accordingly, it is possible to extend a life-span of the EL panel and to prevent badness such as line defect caused by a stress.

Further, in the method and the apparatus of driving the organic EL display device according to the embodiment of the present invention, the period, when the self-aging is performed in the entire EL cells by the voltage difference between the adjacent scan lines and the floating state of the data line, is secured. Accordingly, it is possible to do an aging of the EL panel upon driving.

Moreover, the high and the low aging voltages, oppositely applied to the adjacent scan lines in the aging period, is reversed one more time to thereby improve an aging efficiency. Accordingly, it is possible to extend a life-span of the EL panel and to prevent badness such as line defect caused by a stress.

In addition, in the method and the apparatus of driving the organic EL display device according to the embodiment of the present invention, the period, when the self-aging is performed in the entire EL cells by the voltage difference between the adjacent scan lines and the floating state of the data line, is secured separately from the scan period in the frame. Accordingly, it is possible to do an aging of the EL panel upon driving. Thus, it is possible to extend a life-span of the EL panel and to prevent badness such as line defect caused by a stress.

Otherwise, the neutralization step, in which the same voltage is applied to the adjacent scan lines, is included at least one time in the aging period. Accordingly, it is possible to reduce a parasitic capacitor in the EL panel.

In addition, the aging period, when the self-aging is performed in the entire EL cells by the voltage difference between the adjacent data lines and the floating state of the scan line, is secured separately from the scan period in the frame. Accordingly, it is possible to do an aging of the EL panel upon driving. Thus, it is possible to extend a life-span of the EL panel and to prevent badness such as line defect caused by a stress.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving an electro-luminescence display panel comprising:

applying a scan pulse and a data signal in a scan period to a plurality of electro-luminescence cells formed between a plurality of scan lines and a plurality of data lines; and floating the plurality of data lines and applying an aging voltage to adjacent scan lines to perform a self-aging of an electro-luminescence cell disposed between two scan lines in an aging period, wherein the aging voltage differs from a voltage of the scan pulse, and the aging voltage is inverted relative to the adjacent scan lines.

2. The method according to claim 1, wherein any one aging voltage of high and low aging voltages is applied to an odd-numbered scan line, and an aging voltage opposite to the aging voltage of the odd-numbered scan line is applied to an even-numbered scan line, in the aging period.

3. The method according to claim 2, wherein the aging voltage applied to the plurality of scan lines is reversed at least one time in the aging period.

4. The method according to claim 2, wherein the aging period is divided into a plurality of periods, and the aging voltage applied to each of the scan lines is reversed for each boundary spot of the divided periods.

5. The method according to claim 2, wherein a low scan voltage is supplied to a scan line for an enable and a first high scan voltage is supplied to a scan line for a disable, in the scan period, and wherein a second high scan voltage larger than the first high scan voltage or equal to the first high scan voltage is supplied as the high aging voltage, and the low scan voltage is supplied as the low aging voltage, in the aging period.

6. The method according to claim 1, wherein the aging voltage applied to the plurality of scan lines is reversed at least one time in the aging period.

7. The method according to claim 1, wherein the aging period is divided into a plurality of periods, and the aging voltage applied to each of the scan lines is reversed for each boundary spot of the divided periods.

8. The method according to claim 1, wherein the scan period and the aging period are repeated for each frame.

9. The method according to claim 1, wherein the aging period is disposed in an end of the scan period.

10. The method according to claim 1, wherein the scan period comprising a dummy period of a non-emitting section of the electro-luminescence cells.

11. An apparatus of driving an electro-luminescence display panel, comprising:

a data driver to apply a data signal to a data line in a scan period and to float the data line in an aging period;

a scan driver to apply a scan pulse to a scan line in the scan period and to apply an aging voltage in the aging period to adjacent scan lines having a voltage difference; and an electro-luminescence display panel having an electro-luminescence cell formed for each a cross of both the scan line and the data line, wherein the electro-luminescence cell is emitted in accordance with the data signal in the scan period and a self-aging is performed in the electro-luminescence cell in the aging period, wherein the aging voltage differs from a voltage of the scan pulse, and the aging voltage is inverted relative to the adjacent scan lines.

12. The apparatus according to claim 11, wherein the scan driver applies any one aging voltage of high and low aging voltages to an odd-numbered scan line, and applies an aging voltage opposite to an aging voltage of the odd-numbered scan line to an even-numbered scan line, in the aging period.

13. The apparatus according to claim 11, wherein the scan driver repeats the scan period and the aging period for each frame.

14. The apparatus according to claim 11, wherein the scan driver includes:

a shift register having a plurality of stages to shift a start pulse to supply it as each of output signals and a start pulse of next stage, and a plurality of dummy stages to shift an output signal of the last stage in the stages to secure the aging period; and a level shifter part having a plurality of level shifters to level-shift each of the output signals of the shift register to supply the scan pulse to the scan line in the scan period and to supply an aging voltage opposite to an aging voltage of the adjacent scan lines in the aging period.

15. The apparatus according to claim 14, wherein each of the stages supplies an enable signal corresponding to the shifted start pulse, and wherein the level shifter part divides the aging period into a plurality of period when the enable signal is outputted in the each dummy stage, and reverses the aging voltage applied to each of the scan lines for each boundary spot of the divided periods.

16. The apparatus according to claim 11, wherein the scan driver includes:

a shift register having a plurality of stages to shift a start pulse to supply it as each of output signals and a start pulse of next stage; and a level shifter part having a plurality of level shifters to level-shift each of the output signals of the shift register to supply the scan pulse to the scan line in the scan period and to supply an aging voltage opposite to an aging voltage of the adjacent scan lines in the aging period.

17. The apparatus according to claim 16, wherein the start pulse of the next stage is delayed to be supplied to include the aging period after the scan period.

18. The apparatus according to claim 11, wherein the aging period is disposed in an end of the scan period.

* * * * *